US009689260B2

(12) United States Patent
Liang et al.

(10) Patent No.: US 9,689,260 B2
(45) **Date of Patent: *Jun. 27, 2017**

(54) ROTARY VANE AIR MOTOR WITH IMPROVED VANES AND OTHER IMPROVEMENTS

(71) Applicant: Shining Golden Yida Welding & Cutting Machinery Manufacture Ltd., Hong Kong (HK)

(72) Inventors: Davey Z. Liang, Rancho Santa Fe, CA (US); Daniel S. Cox, Gibsonville, NC (US)

(73) Assignee: Shining Golden Yida Welding & Cutting Machinery Manufacture Ltd., Tsimshatsui, Kowloon (HK)

( * ) Notice: Subject to any disclaimer, the term of this patent is extended or adjusted under 35 U.S.C. 154(b) by 0 days.

This patent is subject to a terminal disclaimer.

(21) Appl. No.: 14/543,698

(22) Filed: Nov. 17, 2014

(65) Prior Publication Data

US 2015/0071806 A1 Mar. 12, 2015

Related U.S. Application Data

(63) Continuation of application No. 13/763,581, filed on Feb. 8, 2013, now Pat. No. 8,915,726.

(51) Int. Cl.

| | |
|---|---|
| ***F01C 21/08*** | (2006.01) |
| ***F01C 1/344*** | (2006.01) |
| ***F01C 19/02*** | (2006.01) |
| ***F01C 13/02*** | (2006.01) |
| ***F01C 1/04*** | (2006.01) |

(52) U.S. Cl.
CPC ..... *F01C 21/0809* (2013.01); *F01C 1/04* (2013.01); *F01C 1/3442* (2013.01); *F01C 1/3445* (2013.01); *F01C 13/02* (2013.01); *F01C 19/02* (2013.01)

(58) Field of Classification Search
CPC ..... F01C 13/02; F01C 1/3445; F01C 21/0809
USPC ..... 418/146, 147, 158, 225, 234, 235
See application file for complete search history.

(56) References Cited

U.S. PATENT DOCUMENTS

| | | | | |
|---|---|---|---|---|
| 2,952,249 A * | 9/1960 | Conover, Jr. | F01C 21/0818 | 418/158 |
| 3,183,843 A * | 5/1965 | Cockburn | F01C 21/0809 | 418/241 |
| 3,452,725 A * | 7/1969 | Kelly | F01C 1/3441 | 418/147 |
| 4,455,129 A * | 6/1984 | Sakitani | F01C 21/0863 | 418/268 |
| 6,589,033 B1 * | 7/2003 | Johnson | F01C 11/004 | 418/158 |

(Continued)

*Primary Examiner* — Mary A Davis
(74) *Attorney, Agent, or Firm* — Philip H. Burrus, IV

(57) ABSTRACT

A rotary vane air motor comprises a rotor, stator and vanes. The rotor has slots for the vanes, and the vanes may move between a retracted position and a contact position in which the vanes contact the cylinder. Each vane may have a longitudinal portion whose shape conforms generally to the slot, and a transverse portion that is radially outside of the slot and extends at least in part in a direction that is transverse to the longitudinal portion and that may be tangential to the perimeter of the rotor at the slot. The shape of the perimeter may be a polygon with rounded corners. The vanes may also include a magnetic portion or a rotating portion.

17 Claims, 21 Drawing Sheets

(56) References Cited

U.S. PATENT DOCUMENTS

| | | | | |
|---|---|---|---|---|
| 8,915,726 | B2 * | 12/2014 | Liang | F01C 1/3445 418/146 |
| 2006/0201156 | A1 * | 9/2006 | Pekrul | F01C 1/44 60/651 |
| 2008/0135338 | A1 * | 6/2008 | Lin | F16N 15/00 184/6.14 |

* cited by examiner

ROTARY VANE AIR MOTOR WITH IMPROVED VANES AND OTHER IMPROVEMENTS

CROSS REFERENCE TO PRIOR APPLICATIONS

This application is a continuation of U.S. application Ser. No. 13/763,581, filed Feb. 8, 2013, which claimed priority from U.S. provisional patent application Ser. No. 61/596,712, filed on Feb. 8, 2012, each of which is incorporated by reference for all purposes.

BACKGROUND

Technical Field

This invention relates to pneumatic motors or air motors and, more particularly, to improved designs for the vanes and rotors thereof, among other aspects.

Background Art

Pneumatic motors or air motors, though widely used for hand tools and other applications, suffer from certain disadvantages. One disadvantage is that the amount of torque or power that can be generated by the motor is constrained by the rate of flow and the pressure of the air or other gas being used. Another disadvantage is that the motors have a limited lifetime, and quality may degrade over time. For example, vanes may wear excessively and/or unevenly, for example due to contact with the cylinder, such that the vane may no longer form a seal with the cylinder, whereby air will flow past the vane resulting in loss of applied pressure, hence loss of torque and power. For another example, residue from oil used to lubricate the motor may accumulate as a sticky gum-like substance on surfaces, causing vanes to become stuck in the slots of the rotor and fail to slide out, thus again resulting in loss of applied pressure and consequent loss of torque and power. Another disadvantage is that the motors require significant maintenance, such as regular lubrication, even upon every use. Accordingly, there is a need for improvements that address these issues.

SUMMARY

In view of the aforementioned issues, embodiments disclosed herein provide improved pneumatic motors.

According to a first aspect, there is provided a pneumatic motor comprising a stator; a rotor disposed such as to define a gap between the rotor and the stator, and disposed for rotation with respect to the stator, the rotor having openings extending in a radial direction of the rotor; and a plurality of vanes disposed in the openings, respectively, each of the vanes being moveable in the radial direction within the respective opening thereof between a contact position, wherein the vane contacts the stator, and a non-contact position, wherein the vane does not contact the stator. The rotor is configured for rotation with respect to the stator by air flow against the vanes. Each of the vanes includes a portion that is permanently located in the gap and does not retract into the respective opening thereof.

According to a second aspect, there is provided a pneumatic motor comprising a stator; a rotor disposed such as to define a gap between the rotor and the stator, and disposed for rotation with respect to the stator, the rotor having a plurality of openings, each opening extending in a radial direction of the rotor, an axial direction of the rotor, and an orthogonal direction, the orthogonal direction being orthogonal to the radial direction and to the axial direction; and a plurality of vanes disposed in the openings, respectively, each of the vanes being moveable in the radial direction within the respective opening thereof between a contact position, wherein the vane contacts the stator, and a non-contact position, wherein the vane does not contact the stator. The rotor is configured for rotation with respect to the stator by air flow against the vanes. A cross-section of any of the vanes taken in a radial-orthogonal plane consists of a first portion having a first orthogonal extent and a second portion having a second orthogonal extent different from the first orthogonal extent, the second portion being located at only one radial end of the first portion.

According to a third aspect, there is provided a pneumatic motor comprising a stator; a rotor disposed such as to define a gap between the rotor and the stator, and disposed for rotation with respect to the stator, the rotor having a plurality of openings, each opening extending in a radial direction of the rotor, an axial direction of the rotor, and an orthogonal direction, the orthogonal direction being orthogonal to the radial direction and to the axial direction; and a plurality of vanes disposed in the openings, respectively, each of the vanes being moveable in the radial direction within the respective opening thereof between a contact position, wherein the vane contacts the stator, and a non-contact position, wherein the vane does not contact the stator. The rotor is configured for rotation with respect to the stator by air flow against the vanes. A cross-section of any of the vanes taken in a radial-orthogonal plane consists of a straight beam portion having a first orthogonal extent and a branch portion having a second orthogonal extent different from the first orthogonal extent, the branch portion extending radially outward of the straight beam portion.

According to a fourth aspect, there is provided a pneumatic motor comprising a stator; a rotor disposed such as to define a gap between the rotor and the stator, and disposed for rotation with respect to the stator, the rotor having openings extending in a radial direction of the rotor; and a plurality of vanes disposed in the openings, respectively, each of the vanes being moveable in the radial direction within the respective opening thereof between a contact position, wherein the vane contacts the stator, and a non-contact position, wherein the vane does not contact the stator. The rotor is configured for rotation with respect to the stator by air flow against the vanes. Each of the vanes includes at least two non-contiguous contact portions, such that, for at least some of the time during which the vane is in the contact position, the at least two non-contiguous contact portions contact the stator at distinct positions, respectively.

According to a fifth aspect, there is provided a pneumatic motor comprising a stator; a rotor disposed such as to define a gap between the rotor and the stator, and disposed for rotation with respect to the stator, the rotor having openings extending in a radial direction of the rotor; and a plurality of vanes disposed in the openings, respectively, each of the vanes being moveable in the radial direction within the respective opening thereof between a contact position, wherein the vane contacts the stator, and a non-contact position, wherein the vane does not contact the stator. The rotor is configured for rotation with respect to the stator by air flow against the vanes. Each of the vanes includes a magnetic portion.

According to a sixth aspect, there is provided a pneumatic motor comprising a stator; a rotor disposed such as to define a gap between the rotor and the stator, and disposed for rotation with respect to the stator, the rotor having openings extending in a radial direction of the rotor; and a plurality of vanes disposed in the openings, respectively, each of the vanes being moveable in the radial direction within the respective opening thereof between a contact position, wherein the vane contacts the stator, and a non-contact position, wherein the vane does not contact the stator. The rotor is configured for rotation with respect to the stator by air flow against the vanes. Each of the vanes includes a rotating portion.

According to a seventh aspect, there is provided a pneumatic motor comprising a stator; a rotor disposed such as to define a gap between the rotor and the stator, and disposed for rotation with respect to the stator, the rotor having openings extending in a radial direction of the rotor; and a plurality of vanes disposed in the openings, respectively, each of the vanes being moveable in the radial direction within the respective opening thereof between a contact position, wherein the vane contacts the stator, and a non-contact position, wherein the vane does not contact the stator. The rotor is configured for rotation with respect to the stator by air flow against the vanes. A cross-section of the rotor is shaped as a polygon with rounded corners.

Other aspects of the embodiments described herein will become apparent from the following description and the accompanying drawings, illustrating the principles of the embodiments by way of example only.

BRIEF DESCRIPTION OF THE DRAWINGS

The following figures form part of the present specification and are included to further demonstrate certain aspects of the present claimed subject matter, and should not be used to limit or define the present claimed subject matter. The present claimed subject matter may be better understood by reference to one or more of these drawings in combination with the description of embodiments presented herein. Consequently, a more complete understanding of the present embodiments and further features and advantages thereof may be acquired by referring to the following description taken in conjunction with the accompanying drawings, in which like reference numerals may identify like elements, wherein:

FIG. 3A is a schematic front end view and FIG. 3B is a schematic interior view, according to some embodiments.

FIG. 4A is a schematic front end view and FIG. 4B is a schematic interior view, according to some embodiments.

FIG. 5A is a perspective side view and FIG. 5B is a perspective bottom view, according to some embodiments.

FIGS. 11A, 11B and 11C are schematic cross-sectional views and FIG. 11D is a schematic top view of the contact surface, according to some embodiments.

FIGS. 12A and 12C are schematic top views of the contact surface and FIG. 12B is a schematic cross-sectional view, according to some embodiments. FIG. 12C also shows a lubricant layer disposed between two magnetic portions. FIG. 12C also shows two magnetic portions disposed along the contact surface where a lubricant layer is disposed between two magnetic portions.

FIG. 13A is a perspective view looking down on the contact surface, with the rotating pin removed from the vane, FIG. 13B is a perspective view illustrating insertion of the rotating pin into the vane, FIG. 13C is a perspective view looking down on the contact surface, with the rotating pin in the vane, FIG. 13D is a schematic cross-sectional view, and FIG. 13E is a perspective end view, with the rotating pin in the vane.

NOTATION AND NOMENCLATURE

Certain terms are used throughout the following description and claims to refer to particular system components and configurations. As one skilled in the art will appreciate, the same component may be referred to by different names. This document does not intend to distinguish between components that differ in name but not function. In the following discussion and in the claims, the terms "including" and "comprising" are used in an open-ended fashion, and thus should be interpreted to mean "including, but not limited to . . . ."

DETAILED DESCRIPTION OF THE DRAWINGS

The foregoing description of the figures is provided for the convenience of the reader. It should be understood, however, that the embodiments are not limited to the precise arrangements and configurations shown in the figures. Also, the figures are not necessarily drawn to scale, and certain features may be shown exaggerated in scale or in generalized or schematic form, in the interest of clarity and conciseness. Relatedly, certain features may be omitted in certain figures, and this may not be explicitly noted in all cases.

While various embodiments are described herein, it should be appreciated that the present invention encompasses many inventive concepts that may be embodied in a wide variety of contexts. The following detailed description of exemplary embodiments, read in conjunction with the accompanying drawings, is merely illustrative and is not to be taken as limiting the scope of the invention, as it would be impossible or impractical to include all of the possible embodiments and contexts of the invention in this disclosure. Upon reading this disclosure, many alternative embodiments of the present invention will be apparent to persons of ordinary skill in the art. The scope of the invention is defined by the appended claims and equivalents thereof.

Illustrative embodiments of the invention are described below. In the interest of clarity, not all features of an actual implementation are described or illustrated in this specification. In the development of any such actual embodiment, numerous implementation-specific decisions may need to be made to achieve the design-specific goals, which may vary from one implementation to another. It will be appreciated that such a development effort, while possibly complex and time-consuming, would nevertheless be a routine undertaking for persons of ordinary skill in the art having the benefit of this disclosure.

Figure 1:
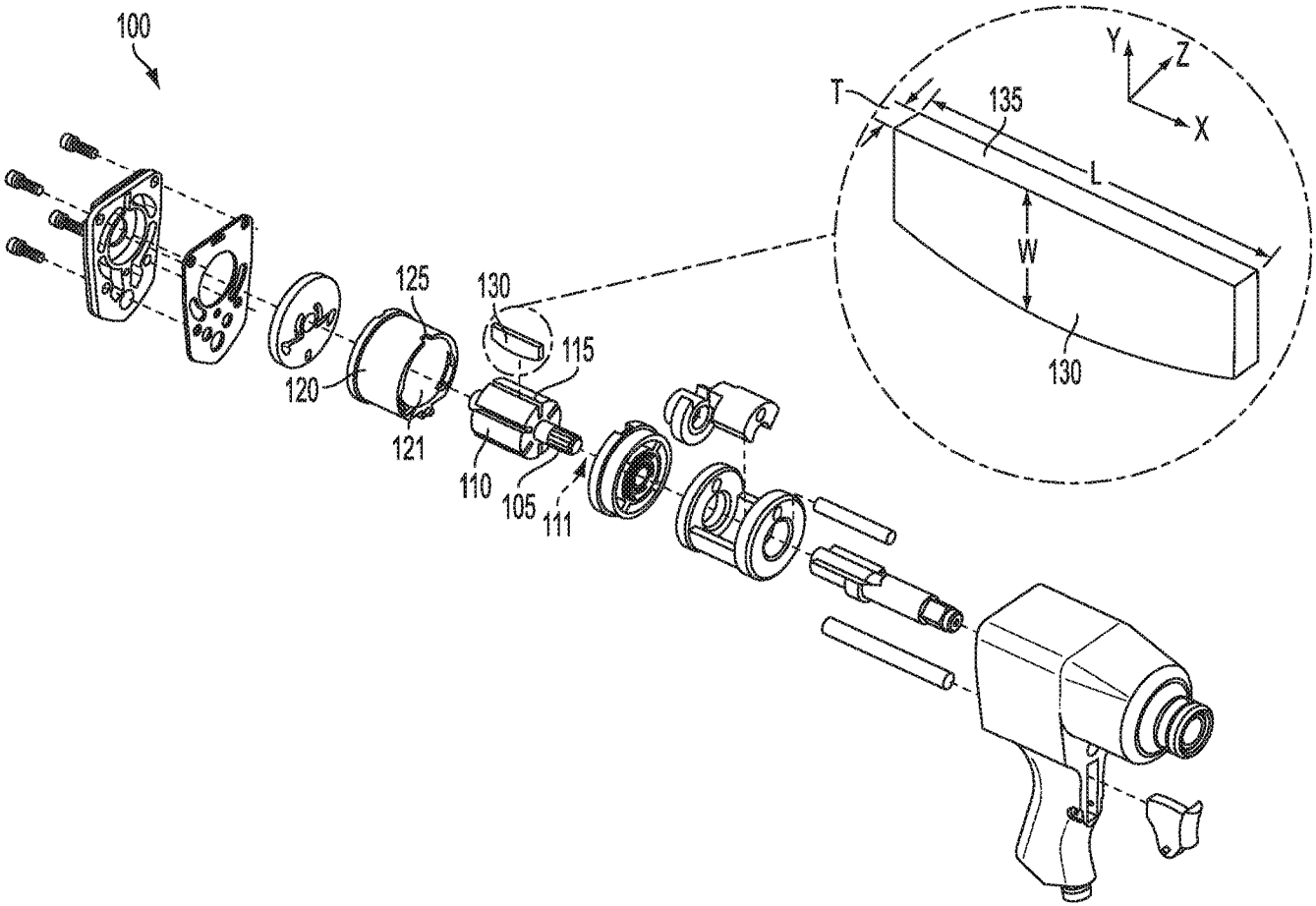
FIG. 1 is an exploded, perspective view of a pneumatic motor for a pneumatic hand tool, according to some embodiments.
Figure 2:
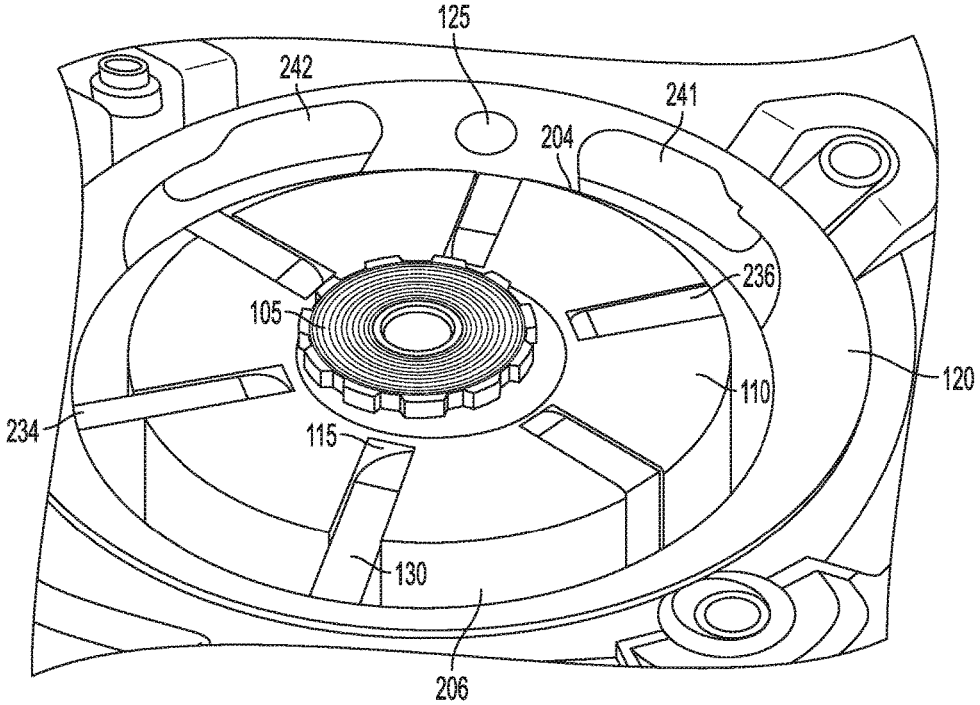
FIG. 2 is a perspective view showing, inter alia, a rotor, a stator and rotor vanes of a pneumatic motor, according to some embodiments.

The reader is referred to FIGS. 1 and 2 for the following discussion. FIG. 1 is an exploded perspective view of a pneumatic motor (of a pneumatic hand tool), with an enlarged detail view of a vane thereof. FIG. 2 is a close up view of the rotor, stator and vanes of such a pneumatic motor.

A pneumatic hand tool may be operated by a pneumatic motor, air motor, or rotary vane (air) motor (the terms will be used interchangeably herein). A pneumatic motor 100 uses compressed air or other gas to drive a shaft 105. (For the sake of convenience, the term "air" will be used herein with the understanding that other gases may also be used.) Shaft 105 is fitted or connected with a rotor 110, which is contained within and rotates with respect to a cylindrical stator 120 (which may be referred to as a "stator" or "cylinder" or "housing"). As seen in FIG. 2, rotor 110 (and shaft 105) may be in an eccentric relationship vis a vis the cylindrical stator 120, such that the axis of rotation 111 of rotor 110 (and shaft 105) is offset from the center axis of the cylindrical stator 120. In FIG. 2, rotor 110 is offset in the upward direction, such that there is only a small gap 204 between rotor 110 and stator 120 at the top of the figure, but a large gap 206 between rotor 110 and stator 120 at the bottom of the figure. Shaft 105 may be concentric with rotor 110. Rotor 110 has radially extending slots 115 (also referred to as "openings") spaced equally about its circumference. Slots 115 extend radially from the outer circumference of rotor 110 (i.e., where rotor 110 meets the gap between rotor 110 and stator 120) almost to the inner circumference of rotor 110 (i.e., almost to where rotor 110 meets shaft 105). Each slot 115 contains a vane 130 that is slidable in the radial direction between a radially inward position in which vane 130 is seated in the bottom of slot 115 ("retracted position") and a radially outward position in which vane 130 has been brought into sealing contact with (inner surface 121 of) cylinder 120 ("contact position"). In FIG. 2, vane 234 is in the contact position and vane 236 is in the retracted position. Speaking generally, when a vane is not in the contact position, it may be said to be in a non-contact position. The term "refracted position" is thus understood to represent a subset of the positions encompassed by the term "non-contact position."

Pneumatic motor 100 also has one or more air (gas) inlet(s) and one or more air (gas) outlet(s). Compressed air enters the gap between rotor 110 and stator 120 through the air inlet and pushes against vanes 130, causing rotor 110 to rotate. More specifically, the incoming air catches a vane 130 and pushes it toward the cylinder 120 such as to bring the vane 130 into sealing contact with (inner surface 121 of) cylinder 120. Over the course of one revolution the vane 130 remains in sealing contact with (inner surface 121 of) cylinder 120. Over the course of one revolution, due to the eccentric relationship between rotor 110 and cylinder 120, the gap between rotor 110 and cylinder 120 gradually increases from (small gap 204 at) 0 degrees (12 o'clock) to (large gap 206 at) 180 degrees (6 o'clock) and then gradually decreases from 180 degrees (6 o'clock) to 360 degrees (12 o'clock). The 0 degree/360 degree or 12 o'clock point may be referred to as the "zenith of the eccentric" or the "eccentric dead top center" and is indicated by reference numeral 125 and the respective semicircle and circle in FIGS. 1 and 2. As the gap increases, vane 130 slides out of its slot 115 in rotor 110, maintaining sealing contact with (inner surface 121 of) cylinder 120. As the gap decreases, vane 130 is forced to slide back, i.e., radially inwardly, in its slot 115, though still maintaining sealing contact with (inner surface 121 of) cylinder 120. At the zenith of the eccentric (360 degrees or 12 o'clock), where the gap decreases to its minimum, or in other words, rotor 110 comes closest to cylinder 120, vane 130 is caused to be pushed back into the retracted position, where it is fully seated at the bottom of its slot 115. (The radially inward end of the slot 115, that is, the end closest to the shaft 105, will be referred to herein as the "bottom" of the slot 115.) As rotor 110 passes the 0 degree point, vane 130 is freed to begin climbing out of its slot 115, where it can again be caught by the incoming air as it commences its next revolution.

Figure 17:
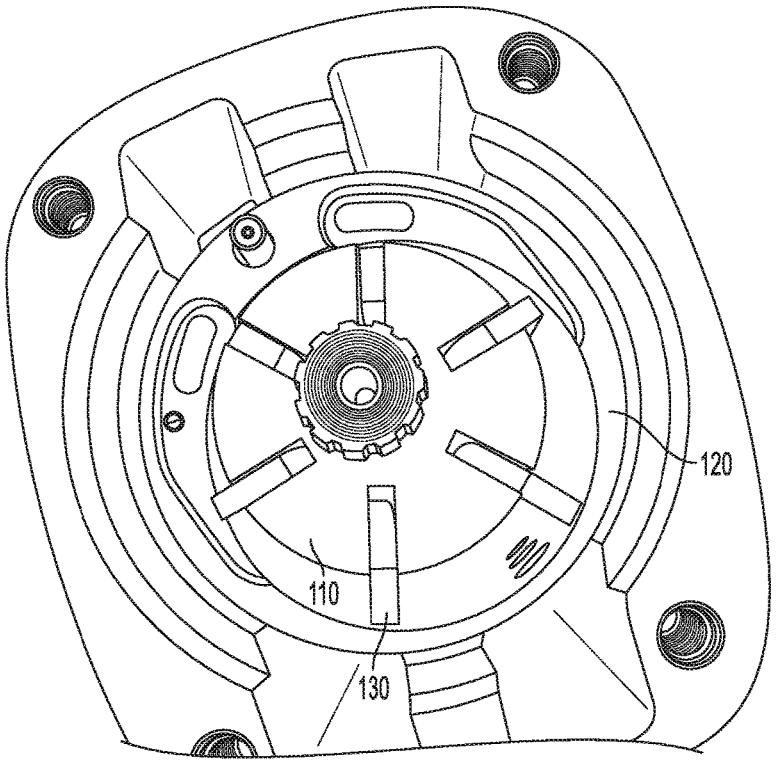
FIG. 17 is a perspective view of an air motor showing the vanes in their proper positions during operation of the motor, according to some embodiments.

In this regard, it will be noted that in FIG. 2 vanes 130 are not all in the positions they would be in during operation of air motor 100. FIG. 17 shows air motor 100 with vanes 130 in the positions they would be in during operation of air motor 100. As seen in FIG. 17, all vanes 130 are in contact or close to contact with cylinder 120. To be sure, it may occur that a vane 130 does not properly function and does not achieve contact with cylinder 120, as explained below.

Figure 3A:
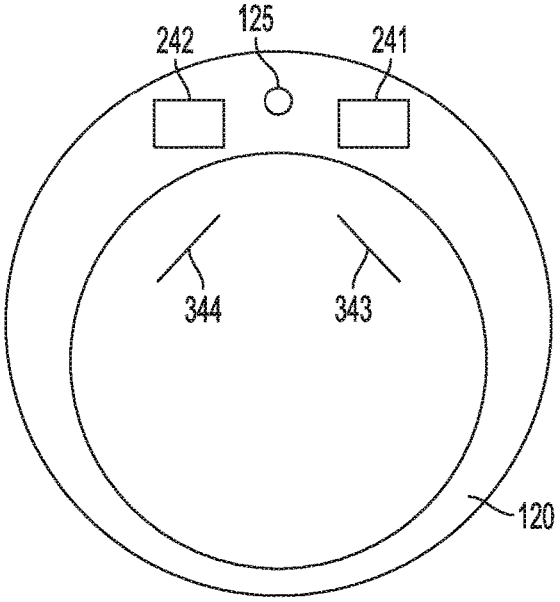
FIGS. 3A and 3B illustrate a first configuration of air inlets and outlets in a stator of a pneumatic motor, where
Figure 3B:
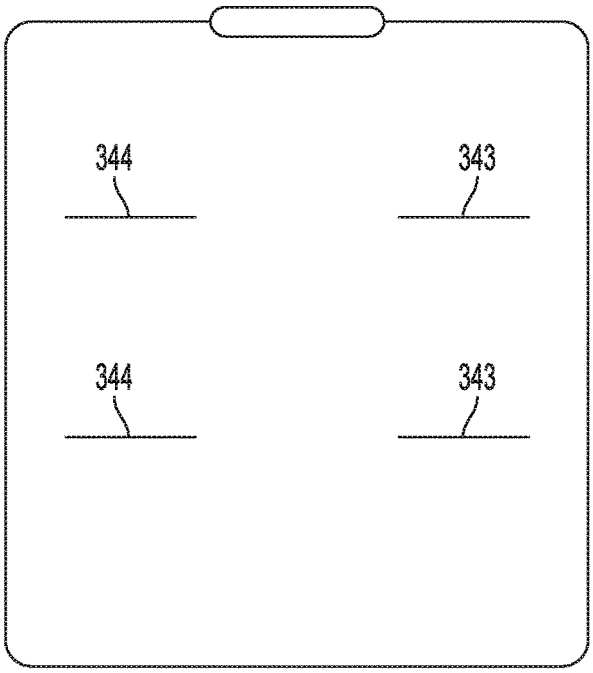
Figure 4A:
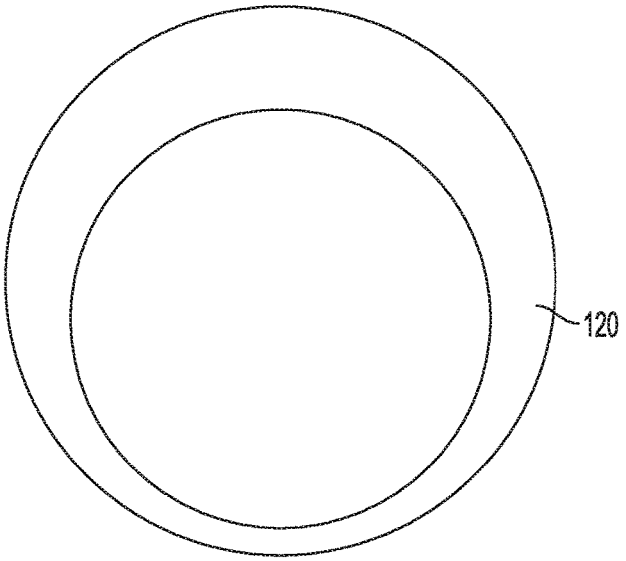
FIGS. 4A and 4B illustrate a second configuration of an air inlet and outlet in a stator of a pneumatic motor, where
Figure 4B:
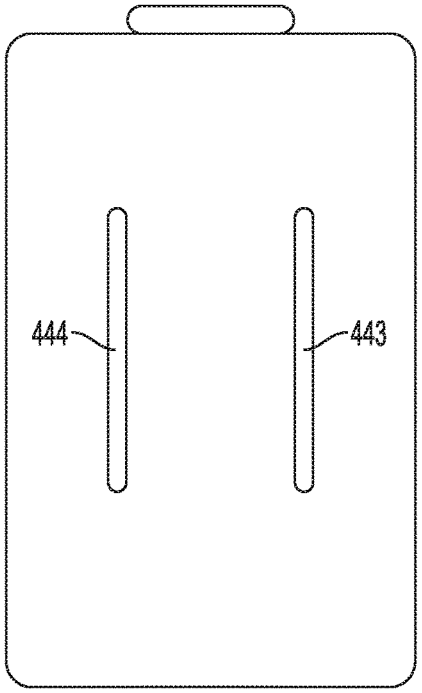
Figure 14:
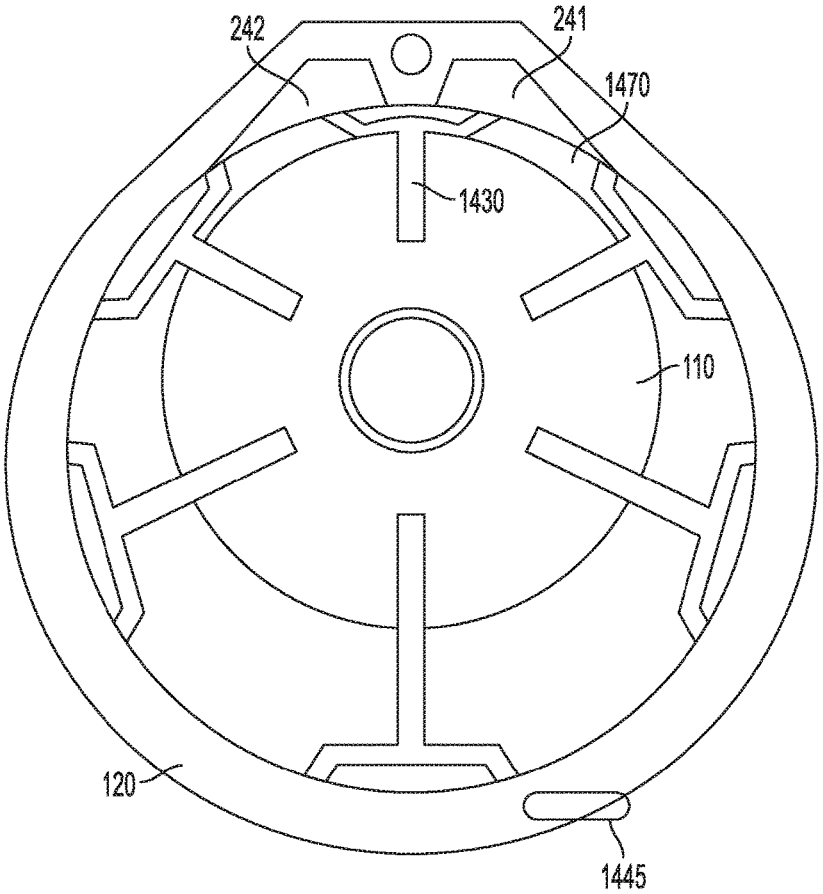
FIG. 14 is a schematic cross-sectional view of an air motor, according to some embodiments.

The air inlets and outlets will be described with reference to FIGS. 2, 3A, 3B, 4A, 4B and 14. FIG. 3A is a schematic front end view of a stator, showing air inlet and outlets. FIG. 3B is a schematic interior view of a stator, showing air inlets and outlets. FIGS. 4A and 4B illustrate the same views as FIGS. 3A and 3B, but with a modified configuration of air inlets and outlets. FIG. 14 is a schematic cross-sectional view of an air motor, showing how the air pushes the vanes.

To summarize prior to invoking the figures, for use of air motor 100 in the forward (i.e., clockwise) direction, the air inlet(s) are located a short distance clockwise of the 0 degree or 12 o'clock point—they may extend from a little after 12 o'clock to approximately 2 o'clock; and the air outlet(s) are located a short distance counterclockwise of the 0 degree or 12 o'clock point—they may extend from approximately 10 o'clock to almost 12 o'clock. For use of air motor 100 in the reverse (i.e., counterclockwise) direction, the air inlet(s) and outlet(s) are reversed. Thus, air motor 100 may have a switching mechanism to switch the flow of air back and forth between the forward and reverse directions.

FIG. 3A is a schematic front end view of cylinder 120 with rotor 110 and shaft 105 removed. FIG. 3B is a schematic view of the upper half of the interior of cylinder 120 looking from below, from the axially central point on the central axis of the cylinder. Cylinder 120 includes auxiliary air inlet 241 (just clockwise of the zenith of the eccentric 125) and auxiliary air outlet 242 (just counterclockwise of the zenith of the eccentric 125) for excess air to flow through, air that does not manage to go through the primary air inlet and outlet (to be described). Auxiliary air inlet 241 and auxiliary air outlet 242 are properly so called for use of air motor 100 in the forward (clockwise) direction. For use of motor 100 in the reverse (counterclockwise) direction, the auxiliary inlet and outlet would be reversed, that is, auxiliary air inlet 241 would serve as auxiliary air outlet and auxiliary air outlet 242 would serve as auxiliary air inlet.

With continued reference to FIGS. 3A and 3B, cylinder 120 is further provided with primary air inlets 343 and primary air outlets 344. Primary air inlets 343 and outlets 344 are located underneath, and communicate with, auxiliary air inlet 241 and outlet 242, respectively. Thus, as with auxiliary air inlet 241 and outlet 242, primary air inlets 343 and outlets 344 are properly so called for use of air motor 100 in the forward (clockwise) direction. For use of air motor 100 in the reverse direction, primary air inlets 343 and outlets 344 would be reversed, that is, primary air inlet 343 would serve as primary air outlet and primary air outlet 344 would serve as primary air inlet. While FIG. 3B shows two primary air inlets 343 and two primary air outlets 344, only one primary air inlet 343 and one primary air outlet 344 are visible in FIG. 3A. In the front end view of FIG. 3A, only the front primary air inlet 343 and the front primary air outlet 344 are visible. Because the rear primary air inlet 343 and the rear primary air outlet 344 are located right behind the front ones, they are not visible in this front end view.

As seen in FIG. 14, an additional air outlet 1445 is provided near the 180 degree or 6 o'clock point. Although shown on one side of 6 o'clock, additional air outlet 1445 could be located on either side of, or at, 6 o'clock, and could include multiple holes rather than merely a single hole as shown. In operation, additional air outlet 1445 may function to let out as much air as, or more air than, the primary air outlet 344.

FIGS. 4A and 4B show a different configuration for the primary air inlet 443 and outlet 444, according to some embodiments of the present invention. As seen in FIG. 4B, the orientation of primary air inlet 443 and outlet 444 has been changed by 90 degrees from that shown in FIG. 3B. In addition, the pair of primary air inlets 343 and pair of primary air outlets 344 of FIG. 3B have been changed to a single, larger primary air inlet 443 and a single, larger primary air outlet 444 of FIG. 4B. The changed orientation means that primary air inlet 443 and outlet 444 now run in a direction parallel to the axis of the cylinder (parallel to axis of rotation 111); accordingly, the length of primary air inlet 443 and primary air outlet 444 is now parallel to the length L of vanes 130 (see FIG. 1). This may improve the flow of air and effective use of air pressure by air motor 100, e.g. the catching of vanes 130 by the air (discussed below). Because as seen in FIG. 4B primary air inlet 443 and outlet 444 run parallel to the axis of cylinder 120, primary air inlet 443 and outlet 444 are not visible, and not illustrated, in the front end view shown of FIG. 4A.

In the front end view of FIG. 4A, auxiliary air inlet 241 and outlet 242 are absent. Thus, one possible design variation is that auxiliary air inlet 241 and outlet 242 are omitted, according to some embodiments of the invention. However, both the presence and the absence of auxiliary air inlet 241 and outlet 242 are possible, regardless of which design of primary air inlet(s) and outlet(s) is used, the one shown in FIG. 3B or the one shown in FIG. 4B. The various embodiments of the present invention (as discussed throughout this application) may be instantiated either with or without auxiliary air inlet 241 and outlet 242.

When the compressed air enters the gap between rotor 110 and stator 120 through the air inlet(s), it enters at an initial or inlet (high) pressure of, e.g., 90 psi. When the air catches the vane 130 at or near, e.g., the 1 or 2 o'clock position, the pressure may have decreased to, e.g., 45 psi. When the vane 130 reaches the 6 o'clock point and the air exits through the additional air outlet 1445, the pressure may have decreased to 0 psi. This decrease in pressure in each revolution of a vane 130 may be understood as corresponding to torque applied to shaft 105 and power generated by air motor 100 (adjustments must be taken into account for losses such as due to friction). The remainder of the revolution of the vane 130 (from 6 o'clock to 12 o'clock) is dead space as far as the production of work by the vane 130 is concerned. In alternative operational arrangements, the air flow may be used to generate work, and hence the decrease in pressure from initial pressure to 0 psi may occur, over a segment of the revolution other than the 180 degree segment (half revolution) described here. In such alternative arrangements, the use made of and/or the position of some or all of the various air outlets (primary, auxiliary and additional air outlets) may be modified as compared to that described here. The particulars of such alternative arrangements would be understood by one of ordinary skill in the art.

As will readily be understood by one of ordinary skill in the art, the above description of a pneumatic motor is subject to a wide range of variations in practice and does not include any number of routine features as will routinely be understood by one of ordinary skill in the art. Accordingly, the present invention is understood to be applicable over a wide range of variation as would be understood by one of ordinary skill in the art, and is not to be taken as limited in respect of such particulars of structure, construction, and operation noted herein.

As described and illustrated in FIGS. 1, 2, 3A, 4A, 6, 14, 17 rotor 110 and stator 120 may both be cylindrical, and rotor 110 may be eccentric with respect to stator 120, such that rotor 110 rotates about a point offset from the center of stator 120, and the radial extent of the gap between rotor 110 and stator 120 varies along the circumference of rotor 110. In addition, the inner circumference of stator 120 may be eccentric with respect to the outer circumference of stator 120. (As discussed below, in some embodiments the rotor may have a modified polygonal cross-section rather than a circular cross-section.)

According to some embodiments, the design of the vanes 130 differs from that illustrated in FIGS. 1 and 2. Three characteristics of vanes 130 will now be described, for the purpose of describing contrasting aspects of different vanes, to be described subsequently, in accordance with some embodiments.

As illustrated in FIGS. 1 and 2, vane 130 is a flat, slat-like structure. In the context of air motor 100, vane 130 may be said to have a length L in the axial (x) direction of the rotor, a width W (shorter than its length) in the radial (y) direction of the rotor, and a thickness T in the orthogonal (z) direction, the orthogonal direction being the direction perpendicular to both the axial and the radial directions and parallel or coincident with a tangent to the perimeter of the rotor 110. As mentioned, the radially inward end of slot 115, that is, the end closest to shaft 105, will be referred to herein as the "bottom" of slot 115; when vane 130 is fully retracted, it is seated at this end of slot 115, and the side of vane 130 closest to this end of slot 115 will likewise be referred to as the bottom of vane 130. As seen in FIG. 1, the bottom of vane 130 is curved, such that the width of vane 130 actually varies as a function of length, being smallest at either end of the length L of vane 130 and greatest at the center of the length L of vane 130. (For simplicity, W is shown in the drawings as the width of the vane at its greatest extent). The thickness T of vane 130 is constant. This constant thickness T of vane 130, or put in other words, this uniform extent of vane 130 in the orthogonal direction, is the first of the three characteristics of vane 130 to be noted.

As illustrated in FIG. 17, at the point at which rotor 110 comes closest to cylinder 120 (i.e., at zenith of the eccentric 125), vane 130 is fully refracted in its slot 115, that is, seated at the bottom of slot 115. In this position, vane 130 does not extend into the gap between rotor 110 and stator 120, but is fully contained within slot 115 of rotor 110: this is the second of the three characteristics of vane 130 to be noted.

As can be understood from FIGS. 1 and 2, when vane 130 is in the contact position, i.e., contacts cylinder 120, vane 130 contacts cylinder 120 along the top surface 135 of vane 130 (i.e., the surface of vane 130 that is radially closest to cylinder 120). This top surface 135 of vane 130 may be referred to as contact surface 135 of vane 130. This top, contact surface 135 of the vane 130 constitutes one single, continuous surface; vane 130 contacts cylinder 120 only at a single, continuous contact surface 135: this is the third of the three characteristics of vane 130 to be noted.

According to some embodiments, the design of the vane differs from that of vane 130. Different embodiments provide different designs of the vane. As will be seen, a number of these various vane designs differ from vane 130 with respect to the above three characteristics of the prior art vane. In the following, the order of presentation will generally be that the structural characteristics of the vanes will be discussed first, followed by a discussion of the advantages provided by the vanes.

Figure 5A:
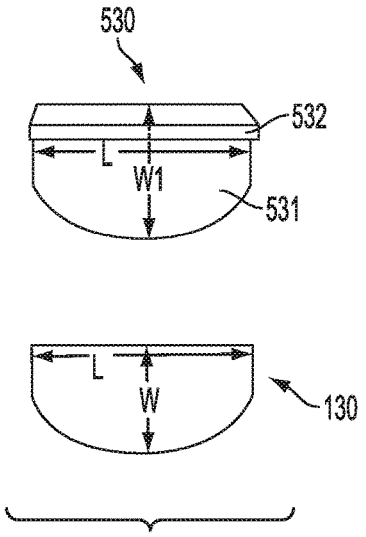
FIGS. 5A and 5B illustrate two different vane designs for a pneumatic motor, where
Figure 5B:
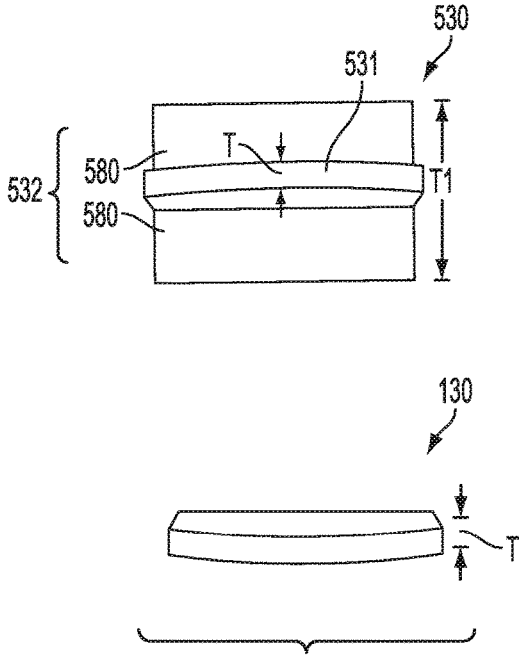
Figure 6:
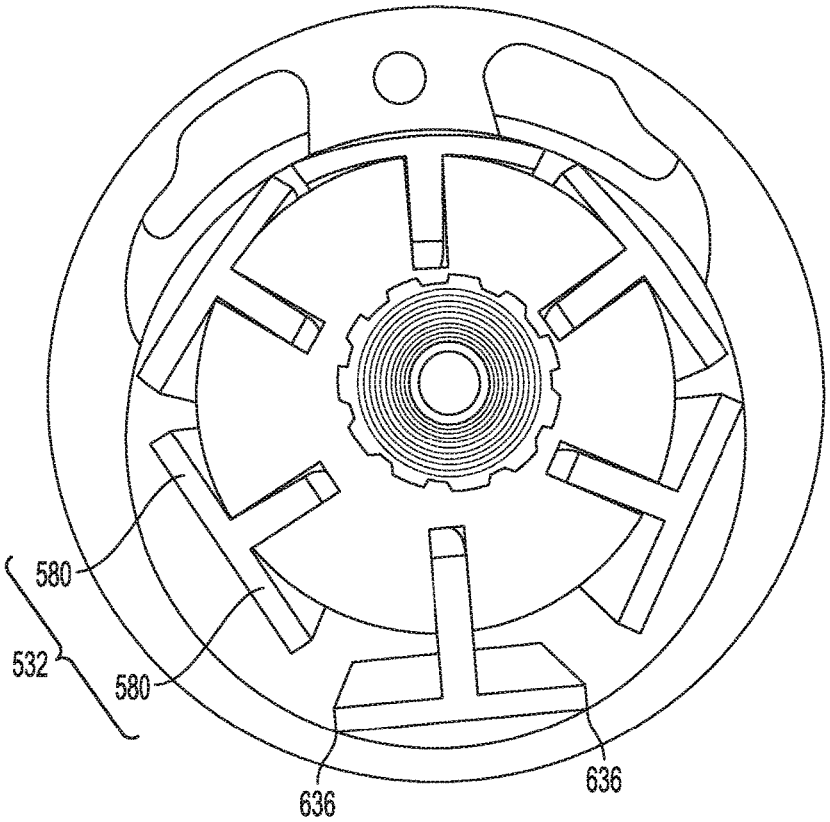
FIG. 6 is a perspective view showing, inter alia, a rotor, a stator and rotor vanes having T-shaped cross-sections, of a pneumatic motor, according to some embodiments.

A first different vane design according to some embodiments is shown in FIGS. 5A, 5B and 6. This vane design is characterized by a T-shaped cross-section, as seen in FIG. 6, as opposed to a straight beam shaped cross-section of vane 130, as seen in FIG. 2. Accordingly, vane 530 may be referred to as a T-shaped vane, while vane 130 may be referred to as an I-shaped vane. The cross-section is a cross-section taken in the radial-orthogonal plane, that is the plane defined by the radial (y) and orthogonal (z) axes (FIG. 1).

As seen in FIG. 5A, vane 130 and vane 530 have the same length L. Vane 530 has a width W1 that is greater than width W of vane 130 due to the horizontal portion of the T. (Actually, the width W of both vanes 130 and 530 varies, in the same manner, as a function of length L; for convenience, the width of both vanes 130 and 530 is shown as the greatest width, which occurs at the center of length L.) As seen in FIGS. 5A and 5B, vane 530 may be understood as being composed of vane 130 (a vane 130 portion 531) and an additional transverse portion 532, at the top of vane 530, corresponding to the horizontal bar of the T-shape. Thus, while vane 130 has a constant thickness T (constant in both the radial and axial directions), vane 530 has a thickness that varies in the radial direction. Vane 530 has a vane 130 portion 531 of thickness T, and a transverse portion 532 of thickness T1. T1 is greater than T. Vane 130 portion 531 may also be referred to as a longitudinal-radial portion, as this portion has greatest dimensions in the longitudinal (x) and radial (y) directions, while transverse portion 532 may also be referred to as a longitudinal-orthogonal portion, as this portion has greatest dimensions in the longitudinal (x) and orthogonal (z) directions.

In T-shaped vane 530, transverse portion 532 may extend in a direction that is tangential to the perimeter of the rotor (see FIG. 6). According to other designs of the vane, described below with reference to FIGS. 7 and 8, transverse portion 532 may extend in a direction that is not tangential to the perimeter of the rotor.

With regard to the T-shaped cross-section, the horizontal bar of the "T" (corresponding to transverse portion 532) may be referred to as two wings or fins 580, one on each side of the vertical bar of the "T" (corresponding to vane 130 portion 531). The T-shaped vane 530 (or cross-section thereof) may also be understood as being composed of a radial (or radially extending) member (or portion) (the vertical bar of the "T," corresponding to vane 130 portion 531) and an orthogonal (or orthogonally extending) member (or portion) (the horizontal bar of the "T," corresponding to the transverse portion 532). The radial member is transverse to the orthogonal member. The T-shaped vane need not be formed of such a radial member and orthogonal member, but could be formed as a single integral piece or of multiple pieces (other than the stated radial member and orthogonal member) joined together to form the T-shaped vane.

The T-shaped vane (or cross-section) may also be described as being composed of a straight beam portion (the vertical bar of the T, corresponding to vane 130 portion 531) and a branch portion (the horizontal bar of the T, corresponding to transverse portion 532), or a straight beam portion that divides into two branches (the two halves of the horizontal bar of the T, on each side of the vertical bar of the T, corresponding to fins 580). The branch portion occurs at only one radial end of the straight beam portion, namely, the radially outward end, i.e., the end that contacts stator 120.

The straight beam portion may be described as having a constant orthogonal extent, i.e., extent in the z direction, i.e., thickness (viz., T), and the branch portion may be described as having a different, greater, constant orthogonal extent, or thickness (viz., T1).

Figure 7:
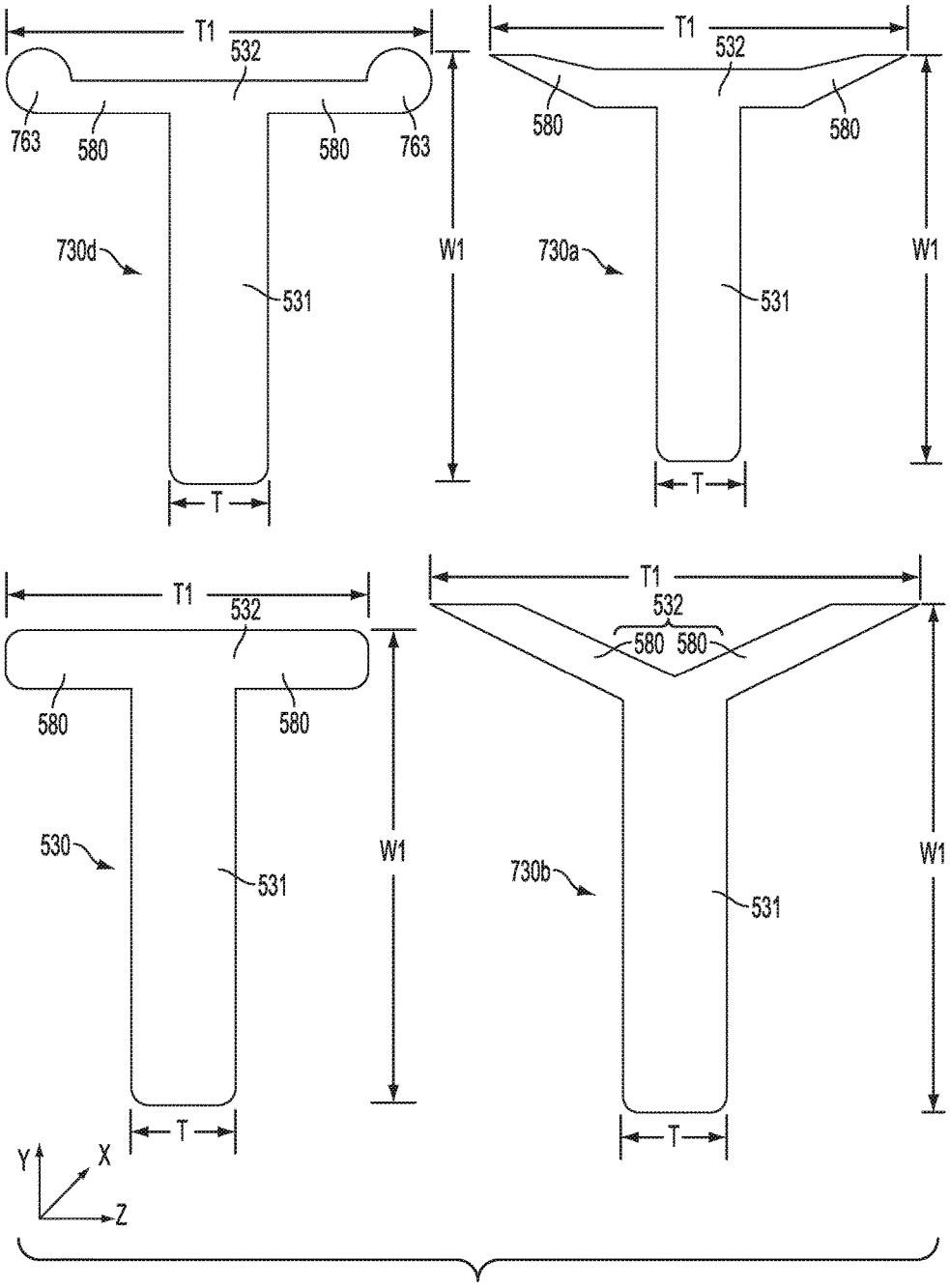
FIG. 7 is a schematic cross-sectional view of four different vane designs for a pneumatic motor, according to some embodiments.

FIG. 7 illustrates four different vane designs, that is, four different vane cross-sections (taken in the radial-orthogonal plane), namely, T-shaped vane 530 (discussed above), and three variations thereon.

Vane 730*a* is a modified version of vane 530, and is characterized by a cross-section that is T-shaped, but with the edges of the fins 580 (the outer tips of the horizontal bar of the T) angled upward. The angle is variable but according to some embodiments is approximately 5 degrees. The cross-section of vane 730*a* may be thought of as in between, or a hybrid of, a T-shape and a Y-shape.

Vane 730*b* is characterized by a cross-section that is Y-shaped, but where the "Y" shape is very close to a "T" shape, specifically, the wings or fins 580 (the arms or branches of the "Y") may each be raised from the horizontal bar of a "T" shape at an angle of approximately 5 degrees. Other angles are also possible. This design may be referred to as a Y-shaped or beveled vane.

Vane 730*d* is a modified version of vane 530, and is characterized by a cross-section that is T-shaped, but with rounded protrusions at the tips of the fins 580 (the tips of the horizontal bar of the T). Of course, since FIG. 7 shows the cross-section, these protrusions in fact represent rounded walls or ridges running the length L of the vane (in FIG. 7, length L extends into the plane of the paper), at either edge of the thickness T1 of transverse portion 532 (i.e., top) of vane 730*d* (that is, at either tip 763 of the horizontal bar of the T).

Vanes 730*a*, 730*b*, and 730*d* being variations on vane 530, it will be understood that the description given above of vane 530 with respect to length L, width W, and thicknesses T and T1, and the vane 130 portion and transverse portion, or radial portion and orthogonal portion, or straight beam portion and branch portion all apply, mutatis mutandis, to vanes 730*a*, 730*b*, and 730*d*, where any points of difference will be evident in view of the illustrated (cross-sections of) vanes 730*a*, 730*b*, and 730*d*.

In addition, in contrast to vane 530, vanes 730*a*, 730*b* and 730*d* may be described as having a branch portion (or transverse portion 532) (a portion having an orthogonal extent, or thickness, different from that of the straight beam portion) that extends radially outward of the straight beam portion (or vane 130 portion 531). That is, transverse portion 532, or at least a part thereof, extends farther in the y direction (i.e., radially outward) than vane 130 portion 531. This is not true of vane 530, where transverse portion 532 extends no further in the y direction than vane 130 portion 531.

Figure 8:
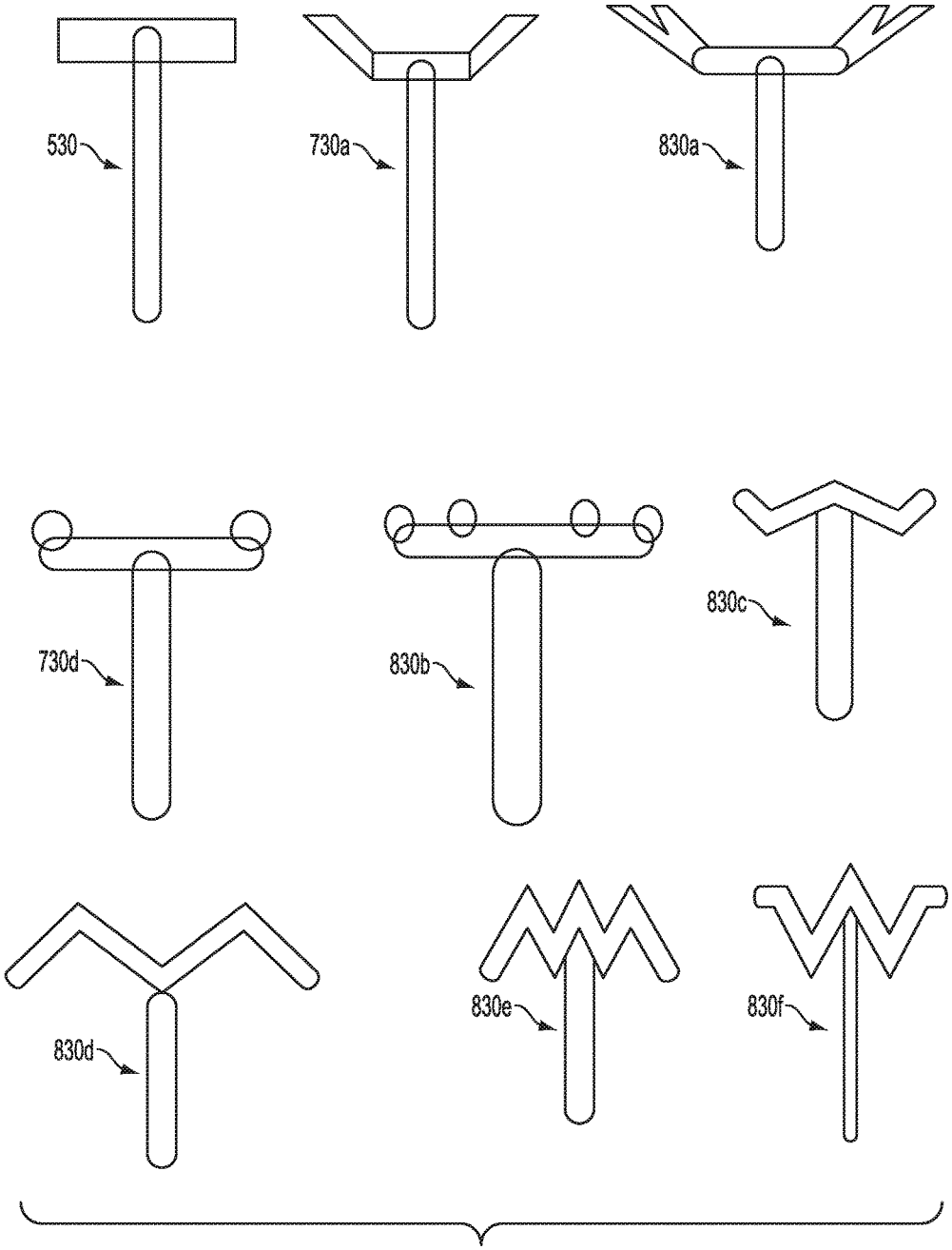
FIG. 8 is a schematic cross-sectional view of nine different vane designs for a pneumatic motor, according to some embodiments.

FIG. 8 illustrates still additional vane designs, or cross-sections, according to various embodiments. The additional vane designs or cross-sections are vanes 830*a*, 830*b*, 830*c*, 830*d*, 830*e*, and 830*f*. In addition, variations on all of the vane designs described heretofore may be made, as will be understood by one of ordinary skill in the art in view of the discussion herein.

It will be noted that all ten vanes 530, 730*a*, 730*b*, 730*d*, 830*a*, 830*b*, 830*c*, 830*d*, 830*e* and 830*f* differ from vane 130 in respect of the first characteristic noted above. That is, for all these ten designs, the thickness T of the vane is not constant, or put in other words, the vane has a non-uniform extent in the orthogonal (z) direction. Specifically, the thickness, or orthogonal extent, varies in the radial (y) direction.

This feature may be seen, for example, in the vane 530 (T-shaped vane), as illustrated, e.g., in FIGS. 5A and 5B. As seen in the figures, the thickness of the T-shaped vane 530 varies as a function of its width W1 (width W1 of T-shaped vane 530 exceeds width W of vane 130, due to the fins 580, or horizontal bar, of T-shaped vane 530). At the vane 130 portion 531 of the T-shaped vane 530 (that is, below the horizontal bar of the T), the thickness of the T-shaped vane 530 is T, the same as the thickness T of vane 130. However, at the transverse portion 532 of the T-shaped vane 530 (at the horizontal bar of the T, or the fins) the thickness of the T-shaped vane 530 is T1, which is much thicker than T.

It is readily apparent from the illustrations thereof that all of the other nine vane designs (i.e., excluding vane 130) also have this feature, namely, the thickness of the vane is not constant, or put in other words, the vane has a non-uniform extent in the orthogonal direction, specifically, the orthogonal extent varies as a function of the radial extent.

All of the above-noted ten vanes 530, 730*a*, 730*b*, 730*d*, 830*a*, 830*b*, 830*c*, 830*d*, 830*e* and 830*f* differ from vane 130 in respect of the second characteristic noted above. That is, for all ten vane designs, the vane has a portion that is permanently located in the gap between rotor 110 and stator 120 and does not retract into the respective slot 115 thereof in rotor 110.

This feature may be seen, for example, in T-shaped vane 530, as illustrated, e.g., in FIG. 6. As seen in that figure, the fins 580 of T-shaped vane 530 (i.e., the horizontal bar of the T, or transverse portion 532) always remain in the gap, throughout the course of the vane's revolution from 0 to 360 degrees. The fins 580 (transverse portion 532) are too large or wide in the orthogonal (z) direction to fit into the opening or slot 115 of vane 530 in rotor 110, hence a portion of vane 130 (viz., transverse portion 532) does not retract into opening or slot 115. It is readily apparent from the illustrations of the other nine vane designs (i.e., excluding vane 130) that they too have this second characteristic. (The fact that fins 580 (traverse portion 532) are too large or wide in the orthogonal (z) direction to fit into the opening or slot 115 of vane 530 in rotor 110 may also be expressed by saying that transverse portion 532 extends beyond the orthogonal extend of the opening or slot 115.)

All of the above-noted ten vanes 530, 730*a*, 730*b*, 730*d*, 830*a*, 830*b*, 830*c*, 830*d*, 830*e* and 830*f* differ from vane 130 in respect of the third characteristic noted above. That is, for all ten designs, the vane includes at least two contact portions, such that, for at least some of the time during which the vane is in the contact position, the at least two contact portions contact the stator at distinct positions, respectively. In addition, the at least two contact portions are non-contiguous, i.e., non-physically adjoining Rather, the at least two contact portions are physically separated from one another.

Figure 9:
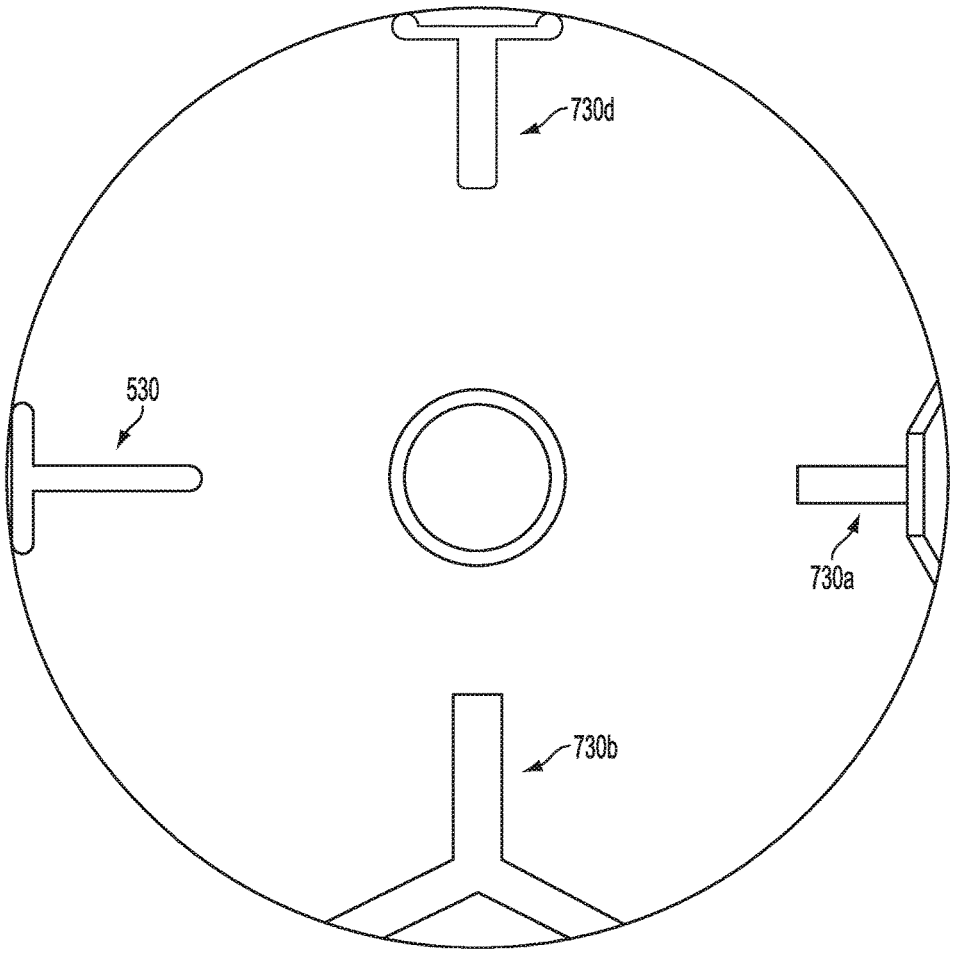
FIG. 9 is a schematic cross-sectional view showing contact between vanes of various designs and a stator, according to some embodiments.

This feature may be seen, for example, in T-shaped vane 530, as illustrated, e.g., in FIG. 6. As seen in the figure, T-shaped vane 530 contacts the inner surface of cylinder 120 at the two tips, or contact portions 636, of (the horizontal bar, or transverse portion 532) of the T (the edges of the fins 580), and not in between the two tips or contact portions 636. Likewise, this feature may be seen in FIG. 9 for vanes 730*a*, 730*b* and 730*d*. It is readily apparent from the illustrations of the other vane designs shown in FIG. 8 that each of them also has two or more such non-contiguous contact portions 636.

Figure 10:
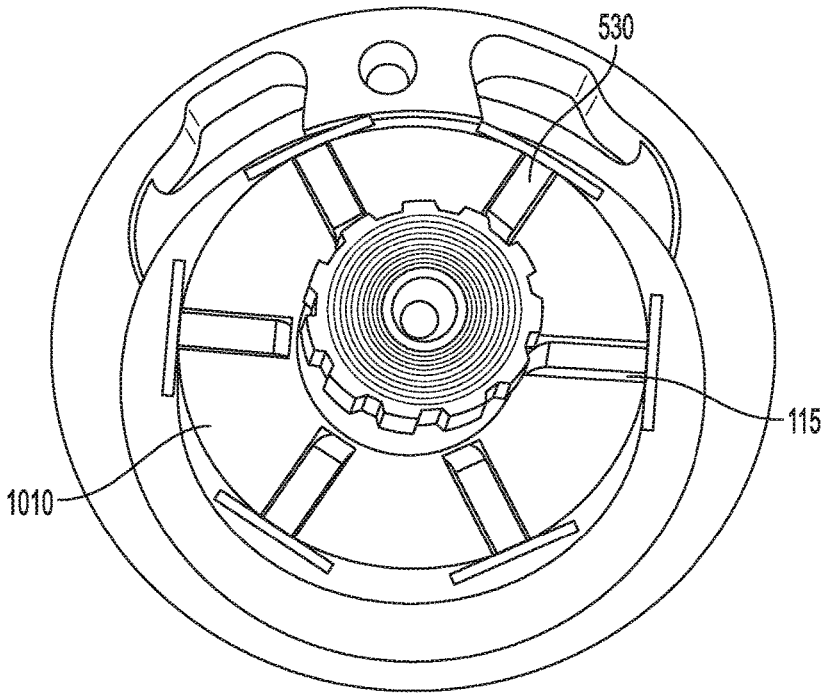
FIG. 10 is a perspective view of a rotor for a pneumatic motor, the rotor having a modified polygonal shaped cross-section, according to some embodiments of the invention.

According to some embodiments, there are provided changes to the design of rotor 110. In this regard, the reader is referred to FIGS. 1, 2 and 10 for the following discussion. As seen from FIGS. 1 and 2, rotor 110 has a circular cross-section taken in the radial-orthogonal (y-z) plane. According to some embodiments, as illustrated in FIG. 10, rotor 1010 has a cross-section whose shape is modified from that of rotor 110. The shape of the cross-section of rotor 1010 is non-circular, but it is close to circular. Specifically, the cross-section of rotor 1010 is a modified polygon, namely, a polygon with rounded corners. The number of sides of the polygon corresponds to the number vanes employed. In FIG. 10, six T-shaped vanes 530 are employed, and so the polygon is a hexagon, with rounded corners. While the illustrations herein show six vanes in a rotor, more or fewer than six vanes may be employed, as will be understood by one of ordinary skill in the art. Accordingly, polygons other than hexagons may be used as the basis for the shape of the cross-section of rotor 1010. It is also noted that the rotor cross-sectional shape of a polygon with rounded corners may be understood to be obtained by modifying the circular shaped rotor 110 cross-section by flattening the circle at the openings of slots 115, i.e., where slot 115 meets the perimeter of the circle. The flat surfaces so obtained would correspond to the sides of the polygon. Thus, in rotor 1010, slots 115 are located at the respective centers of the sides of the modified polygon, and the rounded corners of the polygon are respectively spaced equidistant between slots 115, as shown in FIG. 10.

The modified polygonal shape of the cross-section of rotor 1010 is understood to complement the ten vane designs, vanes 530, 730*a*, 730*b*, 730*d*, 830*a*, 830*b*, 830*c*, 830*d*, 830*e* and 830*f*, and to provide particular advantages when used together with them, as explained below. Nonetheless, these ten vane designs may advantageously be employed without the modified rotor design of FIG. 10. Next, additional rotor vane designs are described with respect to which a modified rotor 1010 cross-section may be used but is not necessarily understood to provide the same particular advantages.

Figure 11A:
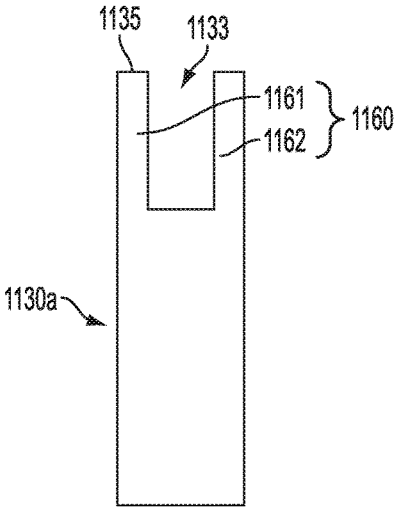
FIGS. 11A, 11B, 11C and 11D illustrate different vane designs for a pneumatic motor, the vanes including a trough in the contact surface, where
Figure 11B:
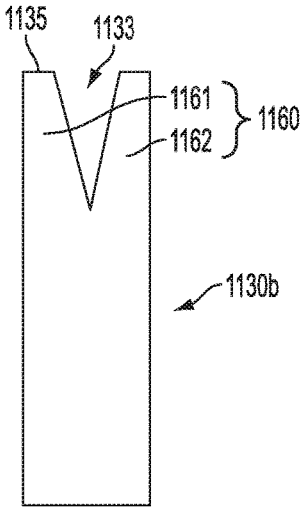
Figure 11C:
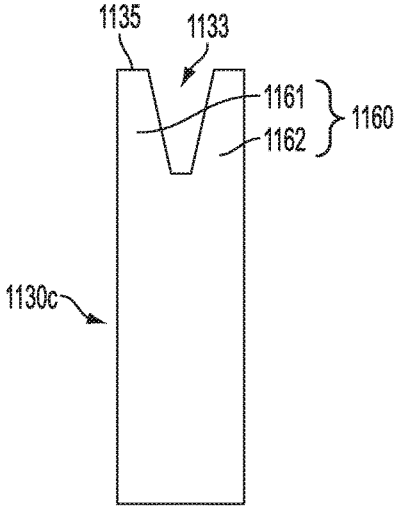
Figure 11D:
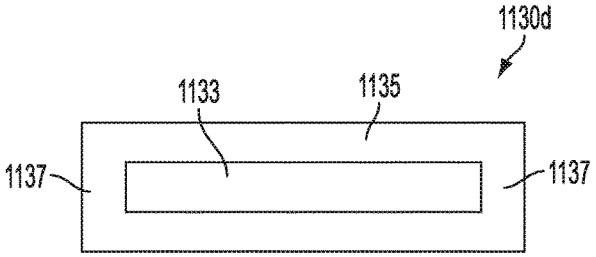

FIGS. 11A, 11B and 11C show three additional vane designs, specifically cross-sections, taken in the radial-orthogonal plane, of vanes 1130*a*, 1130*b* and 1130*c*. FIG. 11D illustrates an additional vane design, providing a view of contact surface 1135 of vane 1130*d*. In each of these vanes, a central portion of contact surface 1135 has been dug out, as it were, to provide a trough 1133 in the vane. Trough 1133 may serve to retain lubricant, e.g., wax, as described below, so as to promote proper lubrication of the air motor. Trough 1133 may run the entire length of the vane or, as illustrated in FIG. 11D, may run a portion of the length of vane 1130*d*, where the ends of trough 1133 are closed off by end portions 1137, such that contents of trough 1133 may be prevented from falling or spilling out of trough 1133. Thus, in vane 1130*d*, contact portion 1135 completely surrounds trough 1133. In vane 1130*a*, trough 1133 has a squared-off U-shaped cross-section, in vane 1130*b*, trough 1133 has a V-shaped cross-section, and in vane 1130*c*, trough 1133 has a hybrid cross-section, between a squared-off U-shape and a V-shape. As will be understood by one of ordinary skill in the art, the trough 1133 cross-section shape may be varied from those illustrated. It is noted that vane 1130*a*, 1130*b* and 1130*c* may be deemed to have a branch portion 1160 made of two branches 1161 and 1162. The term "branch portion" thus refers to the dividing of a single structure into two branch structures. Unlike the branch portions described above with respect to FIGS. 7 and 8, the orthogonal extent or thickness of branch portion 1160 is not greater than that of the straight beam portion, i.e., the remainder of the vane. For this reason, it would not be appropriate to call branch portion 1160 a transverse portion. Therefore, the terms "branch" portion and "transverse" portion are to be deemed not coextensive. Vane 1130*d* would not be deemed to have a branch portion, as it does not have two separate branches because trough 1133 thereof is a single contiguous structure, due to the presence of end portions 1137.

Figure 12A:
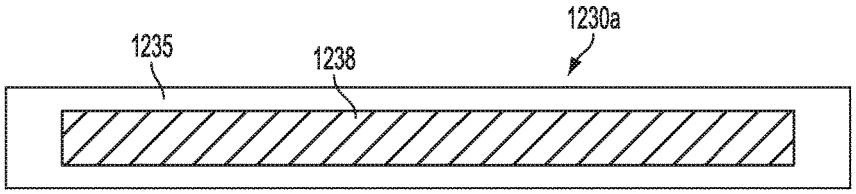
FIGS. 12A, 12B and 12C illustrate different vane designs for a pneumatic motor, the vanes including a magnetic portion at or near the contact surface, where
Figure 12B:
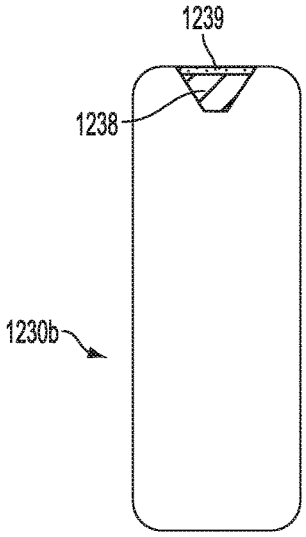
Figure 12C:
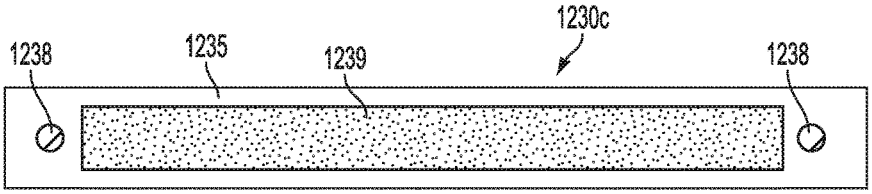

FIGS. 12A, 12B and 12C illustrate additional vane designs, with FIG. 12A showing a view of contact surface 1235 of vane 1230*a*, FIG. 12B showing a radial-orthogonal cross-sectional view of vane 1230*b*, and FIG. 12C showing a view of contact surface 1235 of vane 1230*c*.

In vane 1230*a*, a portion of contact surface 1235 is a magnetic portion (magnetic material) 1238. As illustrated in FIG. 12A, the shape of magnetic portion 1238 may be similar to that of trough 1133 in FIG. 11D. Alternatively, other shapes could be used. The extent of contact surface 1235 that is rendered into magnetic portion 1238 may also be varied from that illustrated. Magnetic portion 1238 of contact surface 1235 may be formed by removing a surface layer of contact surface 1235 (over an area such as that shown for magnetic portion 1238) to a shallow depth (e.g., a few millimeters) and filling in the gap left by the removed surface layer with a magnetic material. The magnetic material may be in the form of a magnetic tape, which may efficiently provide for its adhesion to the vane, or in another form.

Vane 1230*b* includes a magnetic portion 1238 and a lubricant 1239 disposed over magnetic portion 1238. Vane 1230*b* may be thought of as being obtained by modifying vane 1230*a* by placing a lubricant 1239 on top of magnetic portion 1238 (or if need be, removing a slightly greater depth of surface layer of contact portion 1235 so as to place magnetic portion 1238 slightly lower beneath the level of contact portion 1235, and then placing lubricant 1239 on top of magnetic portion 1238). FIG. 12B provides one example of a cross-section of a vane 1230*b* having a magnetic portion 1238 near contact surface 1235 covered by a lubricant 1239 on contact surface 1235. As seen in FIG. 12B, vane 1230*b* may be thought of as containing trough 1233, which is completely filled in with magnetic material to form magnetic portion 1238 and, on top of magnetic portion 1238, a layer formed of lubricant 1239. Of course, in this case, since trough 1233 is completely filled in it does not serve to retain lubricant, etc. as described above with respect to trough 1133. Again, the cross-sectional shape of trough 1233 may be varied from that shown, and the shape and extent of magnetic portion 1238 may be varied as described above with respect to vane 1230*a*.

Vane 1230*c* offers another example configuration of a vane having both a magnetic portion 1238 and a lubricant 1239. As seen in FIG. 12C, vane 1230*c* has a lubricant layer 1239 on most of the portion of contact surface 1235 that was occupied by magnetic portion 1238 in vane 1230*a*. At the longitudinal ends of contact surface 1235, that is, at either longitudinal end of lubricant layer 1239, vane 1230*c* has a small magnet as magnetic portion 1238. While shown as oval or the like shape, the shape and extent of magnets (magnetic portions) 1238 may be varied from that illustrated. These magnetic portions 1238 of vane 1230*c* may be formed as described above. The radial-orthogonal cross-sectional profile (not illustrated) of these magnetic portions 1238 may be varied, as described above with respect to vane 1230*b*.

With regard to the vane designs shown in FIGS. 12A, 12B and 12C, it is also possible to have a vane that has a lubricant layer on the contact surface without having any magnetic portion. As discussed further below, lubricant 1239 may be a wax or other lubricant.

Figure 13A:
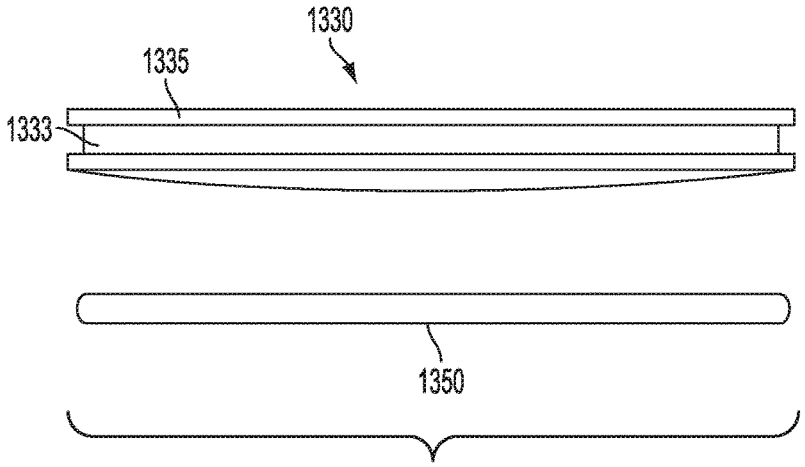
FIGS. 13A, 13B, 13C, 13D and 13E illustrate a vane designs for a pneumatic motor, the vane including a rotating pin, where
Figure 13B:
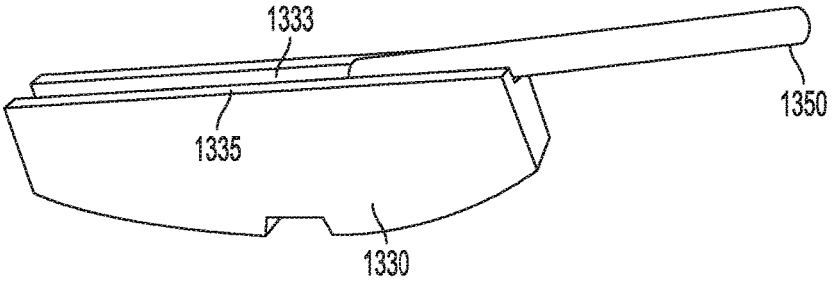
Figure 13C:
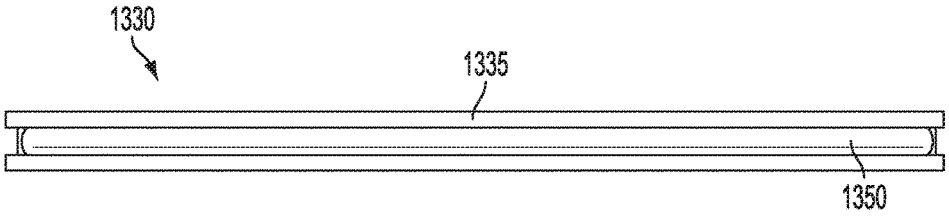
Figure 13D:
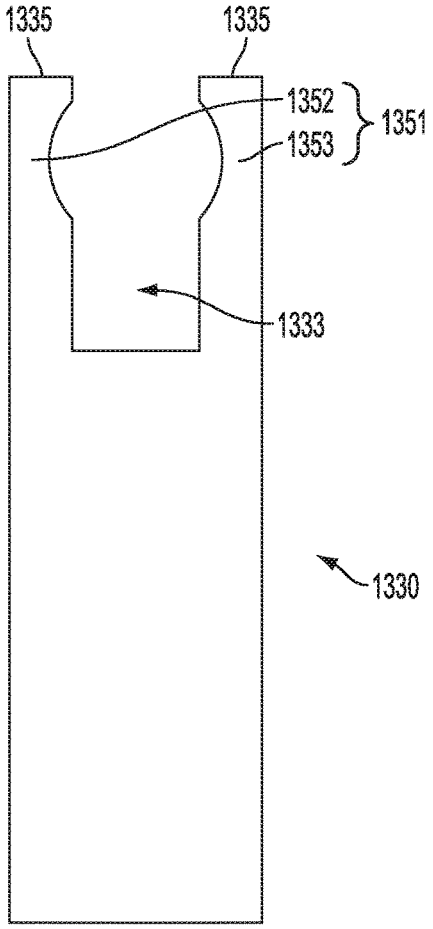
Figure 13E:
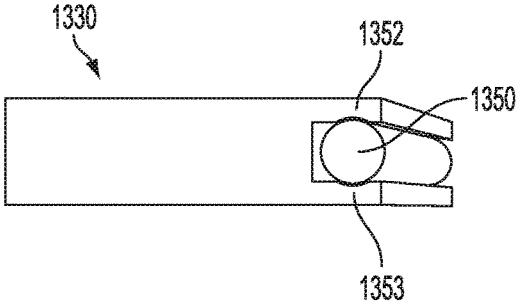

FIGS. 13A-13E illustrate an additional new vane design. In this design, the vane includes a trough and a rotating pin in the trough. FIG. 13A shows the vane, with the rotating pin removed from the vane. FIG. 13B shows how the rotating pin is inserted into the vane. FIG. 13C shows the vane with the rotating pin in place. FIG. 13D shows a radial-orthogonal cross-section of the vane. FIG. 13E shows a longitudinal end view of the vane with the rotating pin in place. (The longitudinal end view of FIG. 13E is thus similar to the radial-orthogonal cross-sectional view of FIG. 13D, but the latter is taken at an end of the vane, not in the middle.)

As seen in FIGS. 13A-13E, vane 1330 includes trough 1333 and rotating pin 1350. Rotating pin 1350 may also be referred to as a rolling pin, or more generally as a rotating portion. Rotating pin 1350 may vary in diameter and length (extent in longitudinal direction x) from that illustrated. Preferably, rotating pin 1350 is cylindrical in shape (circular cross-section). Rotating pin 1350 may or may not be formed of magnetic material. Trough 1333 may serve the same function as trough 1133 described above. As with trough 1133, the cross-sectional profile of trough 1333 may differ from that shown in FIG. 13D (FIGS. 11A-11C offer examples of such variation).

As seen in FIGS. 13C, 13D and 13E, when rotating pin 1350 is in place in vane 1330, rotating pin 1350 extends radially outward from contact surface 1335. This is evident, for example, from the shape of the rotating pin holding portion 1351 as seen in FIG. 13D. Rotating pin holding portion 1351 is situated above trough 1333 and includes two concave portions 1352 and 1353 (like two parentheses) forming portions of a circle. The bottom of the circle would extend through the upper portion of trough 1333 but does not exist. The top of the circle would extend above contact surface 1335 but does not exist. Accordingly, rotating pin 1350 when placed in holding portion 1351 extends slightly radially inward (downward in FIG. 13D) into trough 1333 and slightly radially outward (upward in FIG. 13D) beyond (above) contact surface 1335. Since rotating pin 1350 extends slightly radially outward of contact surface 1335, in operation of an air motor employing vane 1330 with rotating pin 1350 it will be rotating pin 1350, not contact surface 1335, that contacts inner surface of stator 120.

Rotating pin holding portion 1351 is formed with requisite clearances, on the one hand, to permit rotating pin 1351 to rotate and, on the other hand, to retain rotating pin 1351 within holding portion 1351. Thus, rotating pin 1351 is free to rotate while in vane 1330.

It is noted that, like vane 1130*a*, 1130*b* and 1130*c*, vane 1330 may be deemed to have a branch portion made of two branches. The two branches include the two concave portions 1352 and 1353 and extend radially inward (downward in FIG. 13) to the bottom of trough 1333.

It is noted that vane 1330 may be modified to eliminate trough 1333, while retaining clearance at the bottom of holding portion 1351 to retain rotating pin 1350 and permit rotating pin 1350 to rotate.

Where a vane is used with a magnetic portion, e.g., vanes 1230*a*, 1230*b*, 1230*c*, or 1330 (if rotating portion 1350 is magnetic), then stator 120, or inner surface 121 thereof, may be formed of or include a material that may be magnetically attracted by the magnetic portion of the vane or a material that may be magnetically repelled by the magnetic portion of the vane, e.g., a magnetic or ferromagnetic material. As an example, stator 120 or inner surface 121 thereof may be formed of or include steel. In some embodiments, the rotor may be formed of or include a material that may be magnetically attracted by the magnetic portion of the vane or a material that may be magnetically repelled by the magnetic portion of the vane, e.g., a magnetic or ferromagnetic material. In some embodiments, stator 120 or inner surface 121 thereof may formed of or include a magnetic portion and the vanes may be formed of or include a material that may be magnetically attracted by the magnetic portion of the stator or a material that may be magnetically repelled by the magnetic portion of the stator. In some embodiments, the rotor may formed of or include a magnetic portion and the vanes may be formed of or include a material that may be magnetically attracted by the magnetic portion of the rotor or a material that may be magnetically repelled by the magnetic portion of the rotor. All variations such as these are within the purview of one of ordinary skill in the art.

According to some embodiments, any of the following parts may be formed (e.g., by injection molding) of a flexible material such as a low friction plastic or rubber, e.g., nylon: vanes (including fins), rotor, cylinder (stator). In contrast to metal parts, when such materials are used it may not be necessary to lubricate the machine with oil or the like, since the use of such materials reduces friction such as to reduce wear on parts. Further, removing the need for oil reduces the amount of maintenance (e.g., regular lubrication) required and also reduces the incidence of stuck parts (e.g., vanes) due to residues from oil which may form a sticky gum-like substance. Such residues may be water soluble materials that emerge from the oil due to contact with water.

According to other embodiments, in which metal rather than such materials is used, a lubricant, e.g., a wax, may be applied to metal surfaces instead of oil. The wax may be applied, for example, to the vanes, the openings (slots 115) for the vanes, the rotor and the cylinder. The wax may be applied, for example, to any of the following surfaces: any surfaces of the vanes, e.g., surfaces of the vane that contact the rotor or the stator; any surfaces of the stator, e.g., surfaces of the stator that the vanes contact; any surfaces of the rotor, e.g., surfaces of the rotor that the vanes contact, including the surfaces of the openings. Where the vane has a trough 1133 or 1333, wax may be applied in the trough. The wax may be a paraffin wax. The wax may have a dual chain bipolar molecular structure, able to bond to both positively and negatively charged matter. As an example, Dupont Chain Saver (registered Trademarks) dry self cleaning lubricant, which includes such a wax in it, may be used. After application of this lubricant, the wax therein will solidify and generally remain on the metal surfaces, not having to be reapplied. The wax is understood to bond to the metal surfaces and to acquire a negative charge on the outer surface of the wax, which negative charge repels dirt and dust and also other waxed surfaces (e.g., waxed cylinder and waxed vane may repel each other). In this way, the wax serves to reduce friction, and may eliminate the need for oil or other conventional lubricant, and the wax may not result in sticky residues that tend to cause parts (e.g., vanes) to get stuck. Use of wax may also increase efficiency of the motor by reducing loss of air pressure, by eliminating the need to use air flow to blow oil into places needed to be lubricated, which is the case when oil is used for lubrication.

Certain advantages understood to be provided by embodiments set forth herein will now be described, with additional reference to FIGS. 14-16

In this regard, it may be noted that reference is at times made in the instant application to what are understood to be reasons underlying improved performance of embodiments disclosed herein. While statements of such reasons represent the inventors' beliefs based on their scientific understanding and experimentation, the inventors nonetheless do not wish to be bound by theory.

By addition of the fins 580 (transverse portion 532) to the vanes, the ten new vane designs 530, 730*a*, 730*b*, 730*d*, 830*a*, 830*b*, 830*c*, 830*d*, 830*e* and 830*f* provide a larger surface area of the vane for the air in the air motor to press on, as compared to vane 130. This increased surface area means more force (pressure×area), hence more torque and power generated by the motor. This increased force due to increased surface area may be thought of as a "parachute" or "umbrella" effect. In this regard, while the extending of the vane around the rotor in the circumferential direction (—i.e., the fins 580 extend around the rotor in the circumferential direction, in contrast to vane 130, which does not have fins 580—) is understood to be desirable, the fins 580 should not overlap, but rather there should be a gap (in the circumferential direction) between fins 580 of adjacent vanes.

In addition, the ten new vane designs 530, 730*a*, 730*b*, 730*d*, 830*a*, 830*b*, 830*c*, 830*d*, 830*e* and 830*f* and the new rotor design 1010 contribute to the vane (fin 580) establishing a tight seal with the cylinder when the vane is in the contact position, as compared to vane 130. With the T-shaped vane 530, for example, the edges of the transverse portion 532 at the orthogonal ends thereof (or edges of the fins 580, or tips of the horizontal bar of the "T") along the entire length L of the vane will seal to the cylinder. With the vane designs 730*a*, 730*b* and 730*d* (the T-shaped vane whose tips angle upwards, the Y-shaped vane, and the T-shaped vane with rounded protrusions at the tops of the tips of the fins 580), additional flexibility is provided to the fins 580 and in the contact position additional pressure is put on the edges of the fins 580, further enhancing the sealing with the cylinder (illustrated, e.g., by vane 1430 in FIG. 14.) It will be understood that the new vane designs 830*a*, 830*b*, 830*c*, 830*d*, 830*e* and 830*f* also enhance the sealing with the cylinder. The tighter seal helps prevent air from leaking between vane and cylinder, thus increasing the air pressure applied to the vanes and hence the torque and power produced. The tighter seal also helps prevent the occurrence whereby air blows by the vane without catching the vane, thus again eliminating air pressure loss.

In contrast to vane 130, for the ten new vane designs 530, 730*a*, 730*b*, 730*d*, 830*a*, 830*b*, 830*c*, 830*d*, 830*e* and 830*f*, at the zenith of the eccentric (0 degrees or 12 o'clock), while the vane is seated against the rotor, due to the reduction of the gap between rotor and cylinder to a minimum, the vane still seals against the cylinder. The design of rotor 1010, namely, the flat surfaces at the openings (slots 115) for the vanes (i.e., the rotor's modified polygonal shape), also promotes this effect. When pressure is applied to the center of the pair of fins 580 (that is, at the top of the vertical bar of the "T"), the edges of the fins 580 tend to contract by bending. If the rotor were circular (as in rotor 110), the edges of the fins 580 would tend to bend toward the rotor circumference. When the rotor is made to have flat surfaces at the vane openings (slots 115) (as in rotor 1010), the center of the fins 580 is pressed against the flat surface, and the edges of the fins 580 tend to bend toward the cylinder. By maintaining a seal with the cylinder at the zenith of the eccentric, the vane prevents or limits air from crossing over from air inlet side to air outlet side, by physical blocking this crossover route. This is illustrated by vane 1430 in FIG. 14 (although the rotor in this figure is not drawn so as to reflect the modified polygonal shape of rotor 1010). In this way, again efficiency of the motor is enhanced. In contrast, vane 130 is refracted in the slot 115 and does not seal to the cylinder at the zenith of the eccentric, hence does not physically block this crossover route, and so does a worse job of preventing air flow between this inlet and outlet. This is illustrated in FIG. 15 by vanes 130 and the absence of a seal at points 1571 to block crossover route 1575. An air motor employing vanes 130 relies merely on the tight clearance between rotor and cylinder to minimize this air flow.

The ten new vane designs 530, 730*a*, 730*b*, 730*d*, 830*a*, 830*b*, 830*c*, 830*d*, 830*e* and 830*f* also increase the amount of surface area that contacts the cylinder when the vane is in the contact position. This serves to increase friction, which is undesirable. The increase in friction is countered by other factors. First, the vane design provides flexibility in the fins 580. The modified versions of the T-shaped vane, e.g., vanes 730*a*, 730*b* and 730*d*, provide increased flexibility in the fins 580 and reduce friction by virtue of their configurations. Second, nylon or other low friction material may be used for the contacting parts (vanes, cylinder, rotor) as discussed above. Third, where metal is used, wax may be used as discussed above, which reduces friction.

Another advantage provided by the ten new vane designs 530, 730*a*, 730*b*, 730*d*, 830*a*, 830*b*, 830*c*, 830*d*, 830*e* and 830*f* is with respect to wear. First, wear is reduced by reduction of friction, which may be achieved by use of nylon or other low friction materials or by use of wax, as noted. Further in this regard, when nylon or similar material is used for a contact part (e.g. vane), imperfections that occur in the part due to wear inhibit sealing (between vane and cylinder) less than they would if the part were made of a non-flexible/less-flexible material such as metal. Second, the greater surface area of the contact portion of the vane (the portion of the vane that contacts the cylinder) means that as the contact portion (the edges of the fins 580) wears away, there still remains—for a long time—material of the vane to function as the contact portion. Thus, as the edge of a fin 580 wears away, the fin 580 may become smaller, but the remaining outermost portion of the fin 580 becomes the new edge—new contact portion, so the vane can still establish a seal with the cylinder after prolonged wear. Finally, with vane 130, if vane 130 went off kilter for some reason, e.g., moving to a wrong position, it will tend to keep sliding this way and thus keep wearing down adversely (as well as not contributing to generating power). With the ten new vane designs, the vane is much less likely to go off kilter because the air tends much more to properly catch the vane and push it out all the way to the cylinder, as explained next.

Another advantage of the ten new vane designs 530, 730*a*, 730*b*, 730*d*, 830*a*, 830*b*, 830*c*, 830*d*, 830*e* and 830*f* and rotor 1010 design is that they cause the motor to be reliable with respect to the air flow properly catching the vane (as the air enters the gap between rotor and stator) and pushing the vane out to seal with the cylinder. The fins 580 of the vanes together with the modified polygonal shape of the rotor 1010 serve to provide the air with a corner of the fin 580 that is easy to catch as the fin 580 comes round the zenith of the eccentric. This is illustrated in FIG. 14. The air entering the gap between the rotor and the stator from air inlet 241 moves in a clockwise direction and can easily catch the corner of fin 580 at the point 1470. In contrast, with vane 130, there is a significant likelihood that the air may not catch the vane 130 and may instead blow over it. If this occurs, the air flow actually pushes the vane 130 back into the slot 115 of the rotor 110 and prevents it from coming out of the slot 115 to contact the cylinder 120, with resultant loss of power.

The vane designs including a magnetic portion or a rotating pin, though lacking fins 580 (transverse portion 532), also contribute to the vane's establishing a tight seal with the cylinder when the vane is in the contact position, as compared to vane 130, and may provide the attendant advantages described above. These designs are vanes 1230*a*, 1230*b*, 1230*c* and 1330. For example, where the stator is made of a magnetic material, the magnetic portion on or near the contact surface of the vane may be more tightly attracted to the stator due to the magnetic force, and this may cause the vane to maintain constant or near constant contact with the stator. As another example, the added force of the rotating pin 1350 (which may also be magnetic) may promote a tight seal between the vane (rotating pin) and stator.

Figure 15:
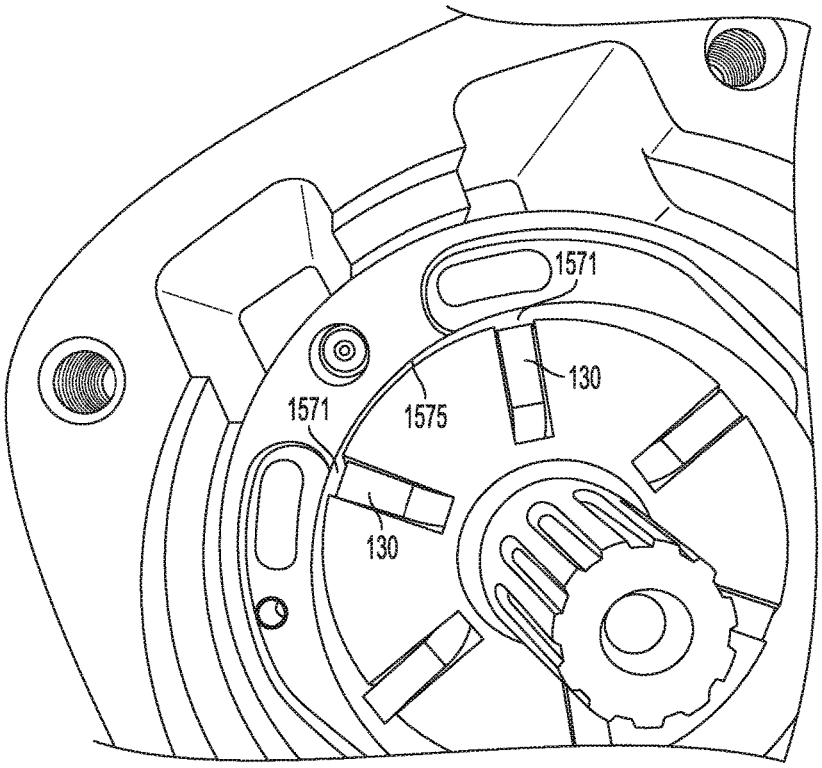
FIG. 15 is perspective view showing a portion of an air motor, illustrating vanes which do not tightly seal against the cylinder at the zenith of the eccentric, according to some embodiments.
Figure 16:
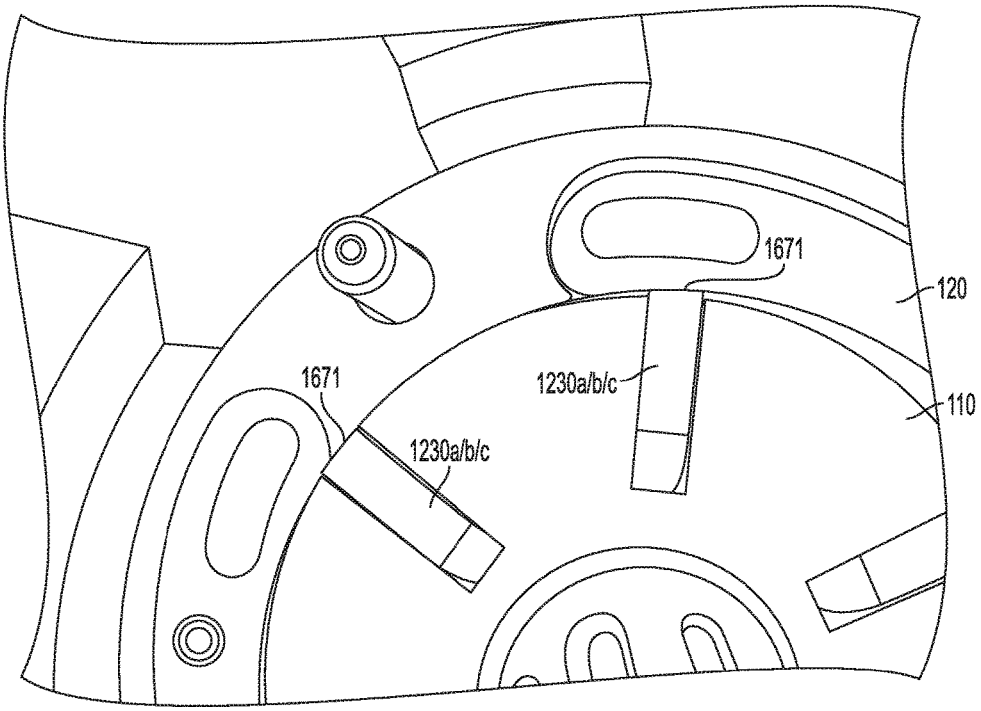
FIG. 16 is perspective view showing a portion of an air motor, illustrating vanes that form a tight seal against the cylinder at the zenith of the eccentric, according to some embodiments.

FIGS. 16 and 15 show the difference between a vane having a magnetic portion (e.g., 1230*a*, 1230*b* or 1230*c*) and vane 130, in respect of forming a tight seal against the cylinder at the zenith of the eccentric and blocking the air crossover route from inlet to outlet side. As explained above, FIG. 15 shows a rotor having vanes 130, which do not tightly seal against the cylinder at the zenith of the eccentric (see points 1571), and permit air to cross over (at 1575) from inlet to outlet side. FIG. 16 shows a rotor having magnetic vanes such as 1230*a*, 1230*b*, or 1230*c*, which form a tight seal (at points 1671) against the cylinder at the zenith of the eccentric, and block air from crossing over (between points 1671) from inlet to outlet side.

Vane designs 1130*a*, 1130*b*, 1130*c* and 1130*d* (with trough 1133) may reduce friction between the vane and the cylinder, and hence may reduce wear, and may provide the attendant advantages described above. For example, the presence of trough 1133 reduces the size of contact surface 1135 that contacts the stator, as compared with contact surface 135 of vane 130. This reduces friction and consequently may permit a tighter seal between vane (contact surface) and stator.

Vanes having a lubrication reservoir in the form of a trough 1133 or 1333 serve to promote good lubrication of the air motor, which may reduce friction and wear.

The increased efficiency of the new designs discussed above permit the same torque and power to be achieved with significantly less air pressure. Thus, e.g., smaller, less expensive compressors can be used with motors having the new designs.

In addition, it will be understood that various aspects (e.g., wear reduction, elimination of oil) of the new designs described above serve to prolong the life of an air motor.

According to some additional embodiments, an air accumulator is provided. The air accumulator is a short portion of the air hose at the inlet to the hand tool (having the air motor), which portion has an increased circumference (diameter) relative to the rest of the air hose. This increased diameter portion serves to increase the volume of air inputted to the tool. If the entire hose length were so widened it would be too heavy and cumbersome to carry around. For a larger machine than a hand tool, air tanks may be used to serve this function. The air accumulator thus avoids the need for an air tank and the need for increasing the diameter of the air hose throughout its length.

As will be understood by one of ordinary skill in the art, embodiments disclosed herein may be applied to any rotary air/pneumatic tool. A non-exhaustive list of such tools includes impact wrenches, drills, grinders, sanders, cut off tools, die grinders, ratchets, etc.

The inventors understand that the inventive features set forth herein may also be applied in other contexts, e.g. fans, cooling, and electric tools, in particular any applications where it is desired to maximize (efficiency of) air flow.

In light of the principles and example embodiments described and illustrated herein, it will be recognized that the example embodiments can be modified in arrangement and detail without departing from such principles. Also, the foregoing discussion has focused on particular embodiments, but other configurations are also contemplated. In particular, even though expressions such as "in one embodiment," "in another embodiment," or the like are used herein, these phrases are meant to generally reference embodiment possibilities, and are not intended to limit the invention to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise, notwithstanding the fact that the claims set forth only a limited number of such combinations.

Similarly, although example processes have been described with regard to particular operations performed in a particular sequence, numerous modifications could be applied to those processes to derive numerous alternative embodiments of the present invention. For example, alternative embodiments may include processes that use fewer than all of the disclosed operations, processes that use additional operations, and processes in which the individual operations disclosed herein are combined, subdivided, rearranged, or otherwise altered.

This disclosure may include descriptions of various benefits and advantages that may be provided by various embodiments. One, some, all, or different benefits or advantages may be provided by different embodiments, even if not explicitly stated.

In view of the wide variety of useful permutations that may be readily derived from the example embodiments described herein, this detailed description is intended to be illustrative only, and should not be taken as limiting the scope of the invention. What is claimed as the invention, therefore, are all implementations that come within the scope of the following claims, and all equivalents to such implementations.

What is claimed is:

1. A pneumatic motor comprising:

a stator;

a rotor disposed such as to define a gap between the rotor and the stator, and disposed for rotation with respect to the stator, the rotor having a plurality of openings extending in a radial direction of the rotor; and a plurality of vanes disposed in the plurality of openings, respectively, each vane of the plurality of vanes moveable in the radial direction within the respective a corresponding opening in which the each vane is disposed between:

a contact position with a contact portion of the each vane contacting the stator; and a non-contact position with the contact portion not contacting the stator;

the rotor rotating with respect to the stator by air flow against the plurality of vanes; and the each vane comprising a magnetic portion disposed within a trough of the each vane such that the magnetic portion is disposed beneath the contact portion;

the each vane further comprising a lubricant disposed within the trough over the magnetic portion.

2. A pneumatic motor according to claim 1, wherein the each vane comprises a portion that is not permanently located in the gap, the portion comprising a side that is curved.

3. A pneumatic motor according to claim 1, the each vane comprising another portion that is permanently located in the gap.

4. A pneumatic motor according to claim 1, the trough retaining the lubricant to promote lubrication of the pneumatic motor.

5. A pneumatic motor according to claim 1, the trough defining a V-shaped cross section.

6. A pneumatic motor according to claim 1, the trough defining a hybrid cross section between a U-shape and a V-shape.

7. A pneumatic motor comprising:

a stator;

a rotor disposed such as to define a gap between the rotor and the stator, and disposed for rotation with respect to the stator by airflow against a plurality of vanes, the rotor having a plurality of openings, each opening extending in a radial direction of the rotor;

the plurality of vanes disposed in the plurality of openings, each vane of the plurality of vanes moveable in the radial direction within a corresponding opening of the plurality of openings between a contact position with a contact surface of the each vane contacting the stator, and a non-contact position with the contact surface not contacting the stator;

a plurality of magnetic portions disposed along the contact surface; and a lubricant layer disposed between magnetic portions of the plurality of magnetic portions.

8. A pneumatic motor according to claim 7, wherein an edge of the each vane disposed opposite the each vane from the contact surface is curved.

9. A pneumatic motor according to claim 7, the plurality of magnetic portions comprising an ovular shape.

10. A pneumatic motor according to claim 7, the lubricant comprising a wax.

11. A pneumatic motor according to claim 7, the plurality of magnetic portions disposed at longitudinal ends of the contact surface.

12. A pneumatic motor comprising:

a stator;

a rotor disposed such as to define a gap between the rotor and the stator, and disposed for rotation with respect to the stator, the rotor having a plurality of openings extending in a radial direction of the rotor; and a plurality of vanes disposed in the plurality openings, each vane of the plurality of vanes moveable in the radial direction within a corresponding opening of the plurality of openings between a contact position contacting the stator and a non-contact position not contacting the stator;

wherein:

air flow against the plurality of vanes rotates the rotor;

the each vane comprises a magnetic portion; and the magnetic portion located beneath the position on the each vane that contacts the stator, further comprising a lubricant disposed on top of the magnetic portion.

13. A pneumatic motor according to claim 12, the magnetic portion located at a radially outward location on the each vane.

14. A pneumatic motor according to claim 12, the each vane defining a trough, the magnetic portion disposed within the trough, the trough extending along a portion of the length of each vane, where ends of the trough are closed by end portions of the each vane.

15. A pneumatic motor according to claim 12, wherein one or more of the stator, the rotor, or the each vane is made of nylon.

16. A pneumatic motor according to claim 12, the stator comprising a material subject to magnetic attraction or repulsion by the magnetic portion of the each vane.

17. A pneumatic motor according to claim 12, wherein a bottom of the each vane is curved.

* * * * *